US005680926A

United States Patent [19]

Sandor et al.

[11] Patent Number: 5,680,926

[45] Date of Patent: Oct. 28, 1997

[54] MECHANICAL INTERLOCK MECHANISM FOR SWITCHED ELECTRICAL CONNECTOR

[75] Inventors: John L. Sandor, Wallingford; Patrick J. Tiberio, Jr., Huntington; John C. Anthony, Fairfield, all of Conn.

[73] Assignee: Hubbell Incorporated, Orange, Conn.

[21] Appl. No.: 442,838

[22] Filed: May 17, 1995

[51] Int. Cl.[6] ..... H01H 9/20

[52] U.S. Cl. ..... 200/51.08; 200/50.11

[58] Field of Search ..... 200/51.08, 51.13, 200/50.11, 50.19

[56] References Cited

U.S. PATENT DOCUMENTS

| | | | |
|---|---|---|---|
| 1,818,290 | 8/1931 | Wulle . | |
| 1,924,691 | 8/1933 | Lofgren . | |
| 1,934,024 | 11/1933 | Anderson . | |
| 1,971,990 | 8/1934 | Reynolds et al. . | |
| 2,015,543 | 9/1935 | Bissell . | |
| 2,241,828 | 5/1941 | Reynolds . | |
| 2,396,901 | 3/1946 | Tiffany | 439/140 |
| 2,397,595 | 4/1946 | Conlan . | |
| 2,441,465 | 5/1948 | Bauroth . | |
| 2,470,944 | 5/1949 | Parish . | |
| 3,122,681 | 2/1964 | Pusch | 200/50.11 X |
| 3,393,395 | 7/1968 | Hubbell . | |
| 3,513,436 | 5/1970 | Nodfelt . | |
| 3,551,880 | 12/1970 | Hartwell . | |
| 3,585,323 | 6/1971 | Appleton et al. . | |
| 3,735,078 | 5/1973 | Appleton et al. . | |
| 3,784,961 | 1/1974 | Gartland, Jr. | 439/465 |
| 3,908,103 | 9/1975 | Gyurka | 200/51.08 X |
| 3,945,702 | 3/1976 | Poliak . | |
| 3,982,804 | 9/1976 | Marechal . | |
| 4,056,298 | 11/1977 | Cooper et al. . | |
| 4,213,667 | 7/1980 | Wittes . | |

(List continued on next page.)

FOREIGN PATENT DOCUMENTS

| | | |
|---|---|---|
| 2342805 | 3/1975 | Germany . |
| 3513591 | 10/1986 | Germany . |

OTHER PUBLICATIONS

Killark Catalog, Electrical Construction Products, 1994, Section 4, pp. 7–10.

Hubbell Catalog, Wiring Device & Systems, Kellems Wire Management Marine Wiring Products, 1995, Section B, pp. B1–B54, Section E, pp. E1–E14 and Section G, pp. G1–G18.

*Primary Examiner*—Renee S. Luebke

*Attorney, Agent, or Firm*—Jerry M. Presson; David L. Tarnoff

[57] ABSTRACT

A switched electrical device adapted to be coupled to a complementary locking type electrical connector by initial relative axial movement therebetween and subsequent relative rotational movement therebetween. The switched electrical device includes a housing with an inlet opening for receiving the complementary electrical connector, a rotatable locking type electrical connector with a set of electrical contacts for engaging the electrical contacts of the complementary electrical connector, a switch mounted within the housing for selectively supplying electrical energy to the set of electrical contacts of the electrical connector, an operating handle for moving the switch between "on" and "off" positions, and an interlock mechanism for releasably locking the switch. The interlock mechanism selectively locks the switch in its "off" position so that it cannot move to its "on" position, until after the complementary electrical connector has been inserted into said opening and rotated to a locked position. The interlock mechanism also prevents removal of the complementary electrical connector from the inlet opening until the operating handle has been moved to its "off" position, which disconnects power to the electrical contacts of the switch connector and the electrical contacts of the complementary connector.

23 Claims, 19 Drawing Sheets

U.S. PATENT DOCUMENTS

| | | | |
|---|---|---|---|
| 4,503,293 | 3/1985 | Knecht . | |
| 4,506,121 | 3/1985 | Peterson et al. . | |
| 4,531,798 | 7/1985 | Baur et al. . | |
| 4,553,000 | 11/1985 | Appleton . | |
| 4,604,505 | 8/1986 | Henninger . | |
| 4,760,220 | 7/1988 | Fritsch et al. | 200/50.11 |
| 4,902,238 | 2/1990 | Iacobucci | 439/135 |
| 5,046,961 | 9/1991 | Hoffman | 439/141 |
| 5,108,297 | 4/1992 | Hoffman et al. | 439/134 |
| 5,298,701 | 3/1994 | Sandor . | |
| 5,507,663 | 4/1996 | Beckmann | 439/357 |

MECHANICAL INTERLOCK MECHANISM FOR SWITCHED ELECTRICAL CONNECTOR

FIELD OF THE INVENTION

The present invention relates to a mechanical interlock mechanism for operating an electrical wiring device with an electrical connector assembly. The mechanical interlock mechanism has an operating handle which cannot move from an "off" position to an "on" position, until a complementary or mating electrical connector is received within the switched electrical connector and rotated to a locked position. When a complementary or mating electrical connector is not inserted into the switch electrical connector, the operating handle is effectively locked by the interlock mechanism such that the handle cannot be rotated to activate the switch and energize the terminals of the electrical connector. The interlock mechanism also prevents removal of the mating electrical connector from the switched electrical connector until the switch is turned to the "off" position. The switched electrical connector can be either a female receptacle or a male inlet.

BACKGROUND OF THE INVENTION

In the manufacture and use of switch boxes of the type having an electrical connector for receiving a complementary electrical connector, which are designed to handle relatively high currents such as 30 amperes to 60 amperes or above, it is considered unsafe to allow the switch to be moved to its "on" position in the absence of a properly inserted complementary electrical connector. Attempting to insert or remove a complementary electrical connector into or from an energized electrical connector of a switch box, especially with a load connected to the complementary electrical connector, can result in arcing between the electrical connectors causing damage to the components as well as a safety hazard to personnel. To prevent this occurrence, switch boxes are commonly provided with some type of interlock mechanism.

One type of switch box with an interlock mechanism is shown in German patent document 23 42 805, which discloses a switch handle having a non-circular coupling to directly operate a conventional switch. A gear train engages teeth on the switch handle, one of the gears having a locking relationship with a spring-urged slider so that the gear train is not rotatable unless the slider is moved to an unlocking position. The slider is adjacent a receptacle shaped and dimensioned to receive a plug of the type having a protruding cam. When the plug is properly inserted, the cam moves the slider and releases the gears so that they can turn, allowing the switch to be turned on after the plug is in. Also, a latching member rotates with the gears to a position behind the cam, preventing extraction of the plug until the switch handle has been rotated to the "off" position.

While this interlock mechanism is functional, it is subject to malfunction. Because the handle is connected to a shaft which directly operates the switch, it is possible to force the handle and the switch, causing the gears to deform or break and jump out of their normal meshing relationship. Thus, this kind of interlock mechanism depends on the integrity of the gear train for its effectiveness.

It is also possible to defeat this type of interlock mechanism by inserting a common probe type of tool, such as a screwdriver, an ice pick or a pencil, to push the latch and begin the rotation of the gear train, extract the probe and then continue the rotation until the switch is operated to the "on" position, thus defeating the interlock mechanism.

To avoid this problem, the interlock mechanism and its components are usually made to be very strong to withstand the abuse. However, increasing the strength of the components is costly, makes the mechanism more difficult to operate, and is not always successful. Typical examples of conventional mechanically interlocked switched outlets which would cause linkage damage upon operation of the switch handle without a plug inserted in the receptacle are disclosed in U.S. Pat. No. 2,241,828 to Reynolds and U.S. Pat. No. 4,604,505 to Henniger.

U.S. Pat. No. 4,506,121 to Peterson discloses a mechanically interlocked switch outlet with a mechanism for preventing overloading of the switched linkage due to improper switch handle operation when a plug is not inserted in the receptacle. Such mechanism permits the handle to move from the off position to the on position without the plug being located within the electrical receptacle and without such handle movement actuating the switch or circuit breaker. In each of the several embodiments disclosed in the Peterson patent, a spring is provided in the mechanism which transmits force between the handle and the switch actuating mechanism. When the plug is inserted in the receptacle, the switch biasing force provides a force transmitting connection between the handle and the switch to actuate the switch. If no plug is received in the receptacle, the force transmission is impeded to an extent that will overcome the biasing force of the spring such that the handle moves to the on position without actuating the switch. However, the force override mechanism of the Peterson patent does not appear to be an effective solution to the problem of the conventional mechanically interlocked switched outlets.

In view of the foregoing, it is apparent that there exists a need for a switched receptacle or inlet with a mechanical interlock which is easy to manufacture, effective and simple to maintain and use, and highly reliable. This invention addresses these needs in the art, along with other needs which will become apparent to those skilled in the art once given this disclosure.

SUMMARY OF THE INVENTION

One object of the present invention is to provide a safety switched receptacle or inlet with a dead front which is easy to manufacture, effective and simple to maintain and use and is highly reliable.

Another object of the present invention is to provide a receptacle or inlet with an improved interlock to prevent operation of the switch to an "on" position unless an electrical connector is properly inserted into the receptacle or inlet, and to prevent extraction of the electrical connector so long as power is being supplied to the receptacle or inlet.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring now to the drawings which form part of this original disclosure.

DETAILED DESCRIPTION OF THE INVENTION

Figure 1:
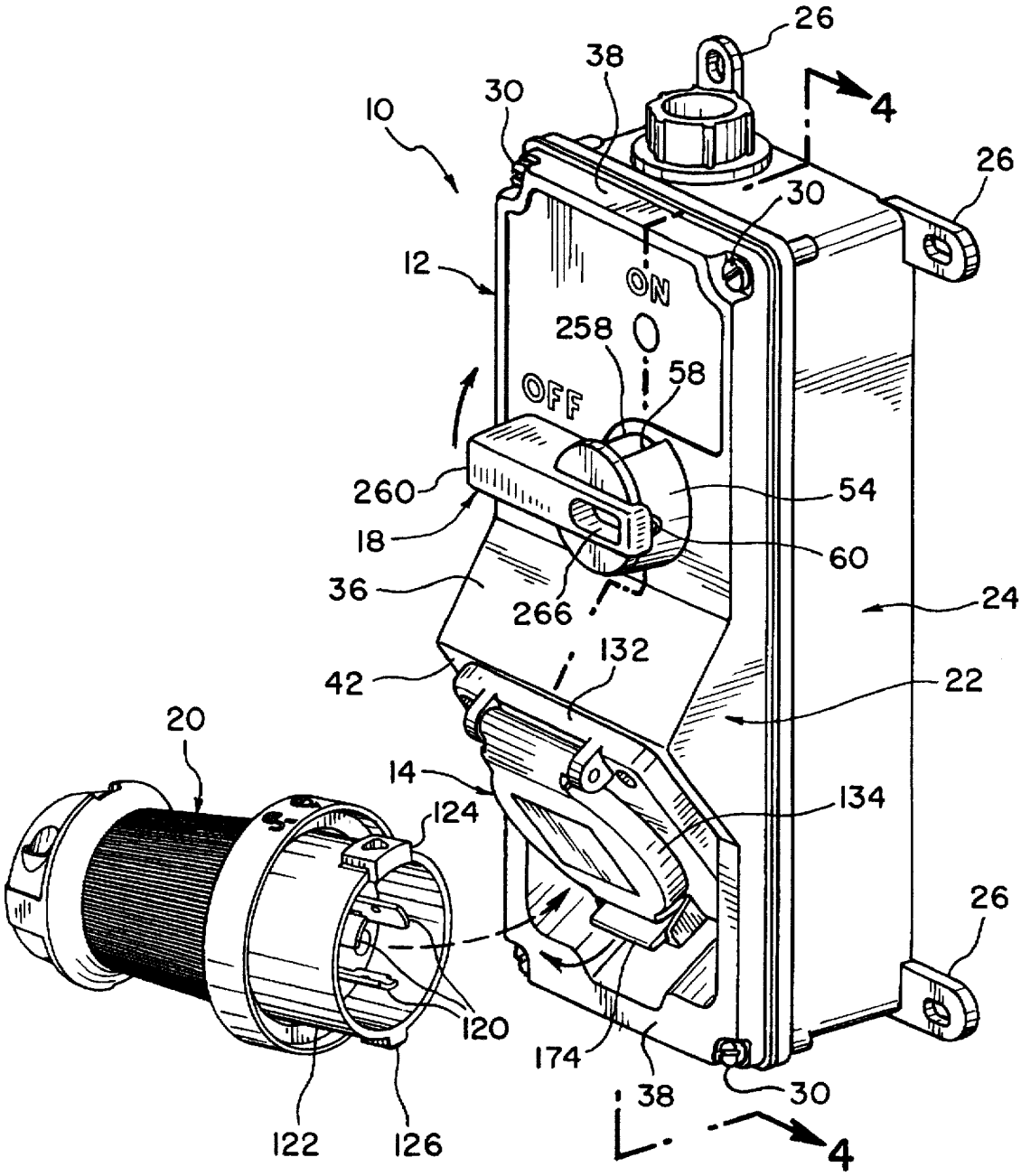
FIG. 1 is a front perspective view of an electrical device in the form of a receptacle with a mechanical interlock mechanism in accordance with the present invention, which is illustrated together with a mating locking type electrical connector.

Referring initially to FIGS. 1–5, an electrical wiring device 10 in accordance with the present invention is illustrated. Electrical wiring device 10 includes an enclosure assembly 12, an electrical connector assembly 14, a switch assembly 16 and a mechanical interlock mechanism 18. Electrical wiring device 10 is illustrated as a receptacle for receiving a male electrical connector or plug 20. Of course, electric wiring device 10 can be designed in the form of an inlet to receive a complementary female electrical connector to make an electrical connection therebetween.

More specifically, electrical wiring device 10 can be designed to be coupled with a rotatable locking type electrical connector such as the male locking type electrical connector or the female locking type electrical connector disclosed in U.S. patent application Ser. No. 08/354,738, filed Dec. 8, 1994 in the name of Patrick J. Tiberio, Jr. The disclosure of U.S. patent application Ser. No. 08/354,738 is hereby incorporated herein by reference. Preferably, electrical connector 20 is constructed in the same manner as the male locking type electrical connector disclosed in U.S. patent application Ser. No. 08/354,738. Thus, electrical connector 20 will not be discussed in detail herein. Accordingly, the present invention will be described for purposes of understanding the present invention with electrical wiring device 10 being a receptacle and mating electrical connector 20 being a shrouded male electrical connector with polarizing members.

Mating or complementary electrical connector 20 is coupled to electrical connector assembly 14 of electrical wiring device 10 by first relative axial insertion and then relative rotation therebetween for electrically coupling mating electrical connector 20 with electrical connector assembly 14. However, electrical power is not supplied to either mating electrical connector 20 or electrical connector assembly 14, until switch assembly 16 is turned from an "off" position to an "on" position in which electrical power is supplied to electrical connector assembly 14 as discussed in detail below.

Switch assembly 16 is controlled by mechanical interlock mechanism 18 such that switch assembly 16 cannot be moved from an "off" position to an "on" position, until mating electrical connector 20 is properly inserted within electrical connector assembly 14 and then rotated to its locked position as discussed in detail below. When mating electrical connector 20 is not properly inserted into electrical connector assembly 14, mechanical interlock mechanism 18 locks the switch assembly 16 in its "off" position.

Moreover, mechanical interlock mechanism 18 prevents removal of mating electrical connector 20 from electrical connector assembly 14, when switch assembly 16 is in the "on" position. In other words, mating electrical connector 20 cannot be removed from electrical connector assembly 14 until switch assembly 16 is in its "off" position such that no electrical power is supplied to electrical connector assembly 14 and electrical connector 20.

Enclosure Assembly 12

As seen in FIGS. 1–4, enclosure assembly 12 includes an outer enclosure cover 22, a back enclosure member 24 with four mounting flanges 26 and an inner mechanism cover 28. Electrical connector assembly 14, switch assembly 16 and mechanical interlock mechanism 18 are all mounted to enclosure assembly 12.

In particular, electrical connector assembly 14 is removably coupled to the exterior surface of outer enclosure cover 22 with a portion of electrical connector assembly 14 extending into the interior of enclosure assembly 12 for being electrically coupled to switch assembly 16 by wires 29 and mechanically coupled to mechanical interlock mechanism 18. Switch assembly 16, on the other hand, is removably coupled to back enclosure member 24 and is concealed within enclosure assembly 12 when outer enclosure cover 22 and back enclosure member 24 are coupled together. Mechanical interlock mechanism 18 is coupled to the interior surface of outer enclosure cover 22 by inner mechanism cover 28 with part of interlock mechanism 18 extending out of enclosure assembly 12 for operating switch 16 and interlock mechanism 18 as discussed below.

The details of enclosure assembly 12 are not important to the present invention, except that outer enclosure cover 22 and inner mechanism cover 28 have structure for holding and controlling the movement of electrical connector assembly 14 and mechanical interlock mechanism 18. Thus, enclosure assembly 12 will not be discussed in detail herein except as necessary to understand the present invention.

Figure 3:
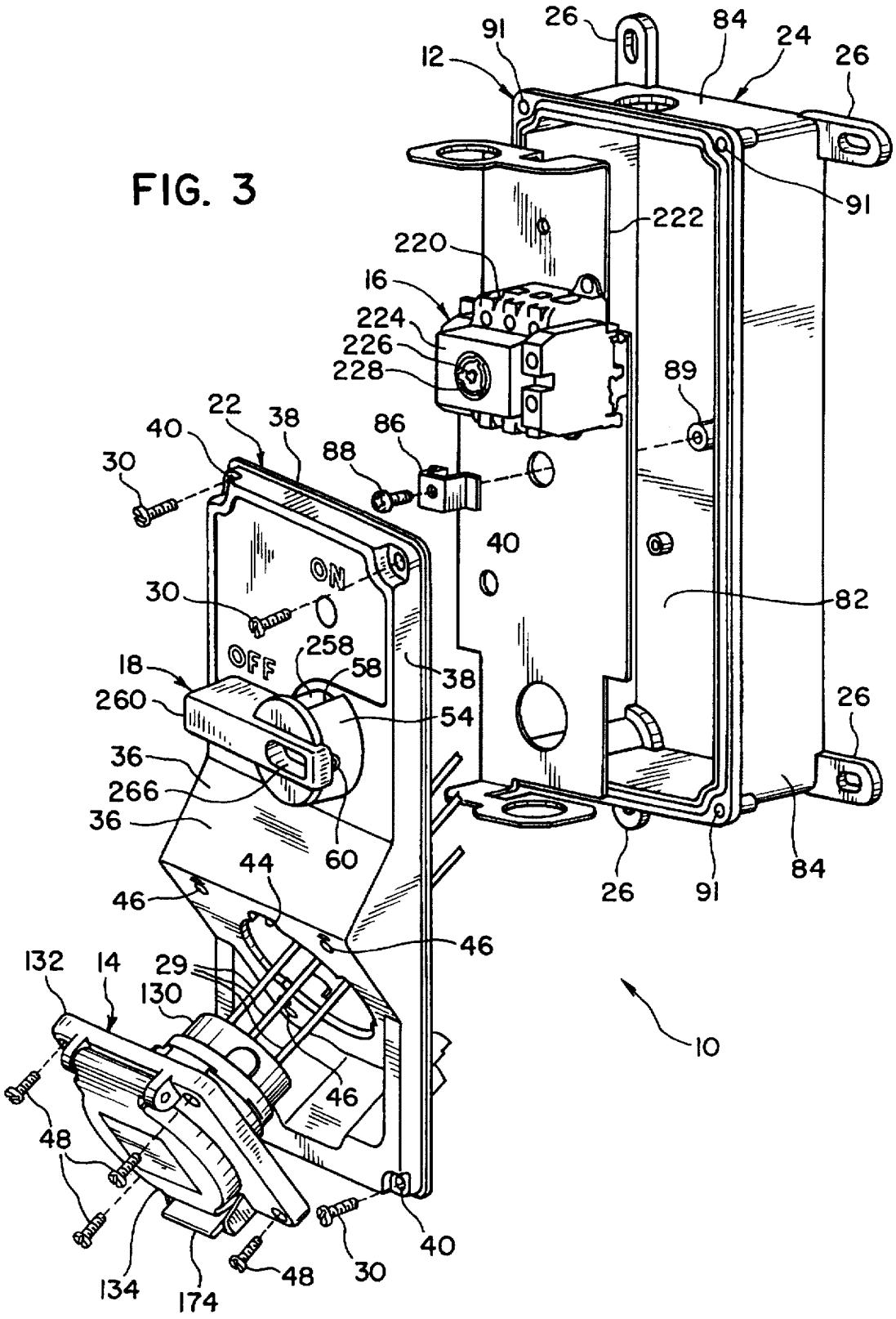
FIG. 3 is a partially exploded, front perspective view of the switched electrical device with the mechanical interlock mechanism illustrated in FIGS. 1 and 2.
Figure 24:
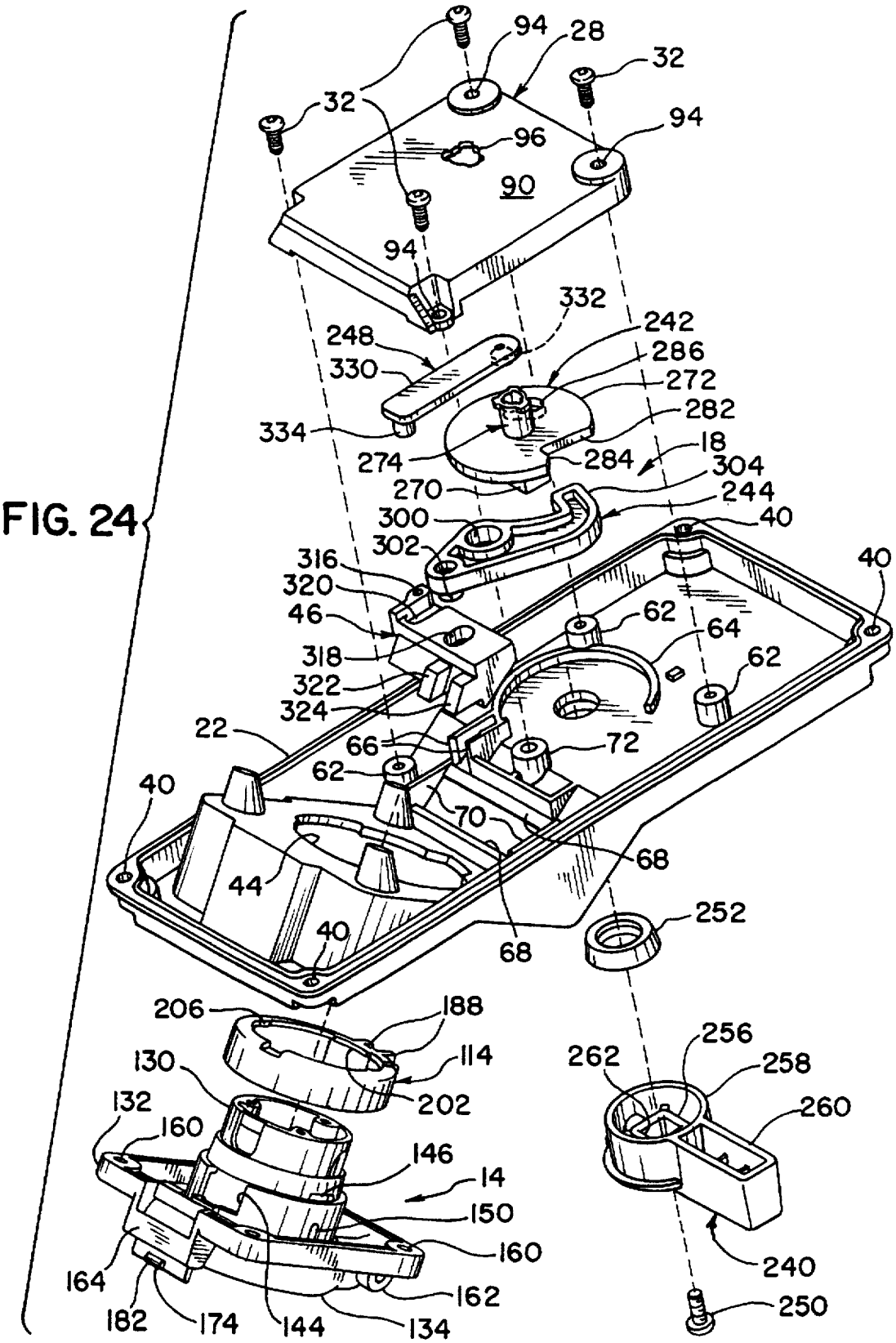
FIG. 24 is an exploded perspective view of certain parts of the switched receptacle and mechanical interlock mechanism illustrated in FIGS. 1–4 and 12–22.

As best seen in FIGS. 3 and 24, outer enclosure cover 22 is releasably coupled to back member 24 by four screws 30, while inner mechanism cover 28 is coupled to outer cover 22 by four screws 32. Outer enclosure cover 22, back member 24, flanges 26 and mechanical inner cover 28 are all preferably constructed of a hard, rigid insulating material such as plastic. One such suitable plastic is a polyester blend such as GE's Valox 3570. Outer cover 22 and back member 24 may be exposed to the sun and are preferably constructed of a UV-stabilized plastic material.

A gasket 34 is provided between outer enclosure cover 22 and back enclosure member 24 to seal enclosure assembly 12. More specifically, gasket 34 is positioned within a groove formed along the outer edge of back enclosure member 24 and squeezed between outer enclosure cover 22 and back enclosure member 24 to form a watertight seal therebetween.

As best seen in FIG. 3, outer enclosure cover 22 has a substantial rectangular configuration with a contoured top wall 36 and four downwardly extending side walls 38. A mounting hole 40 is provided at each corner of top wall 36 for receiving one of the screws 30 for releasably mounting outer enclosure cover 22 to back enclosure member 24. Top wall 36 also has a slanted surface 42 with a large cutout 44 for receiving a portion of electrical connector assembly 14 therein and four mounting holes 46 for receiving screws 48 to releasably couple electrical connector assembly 14 thereto.

Figure 4:
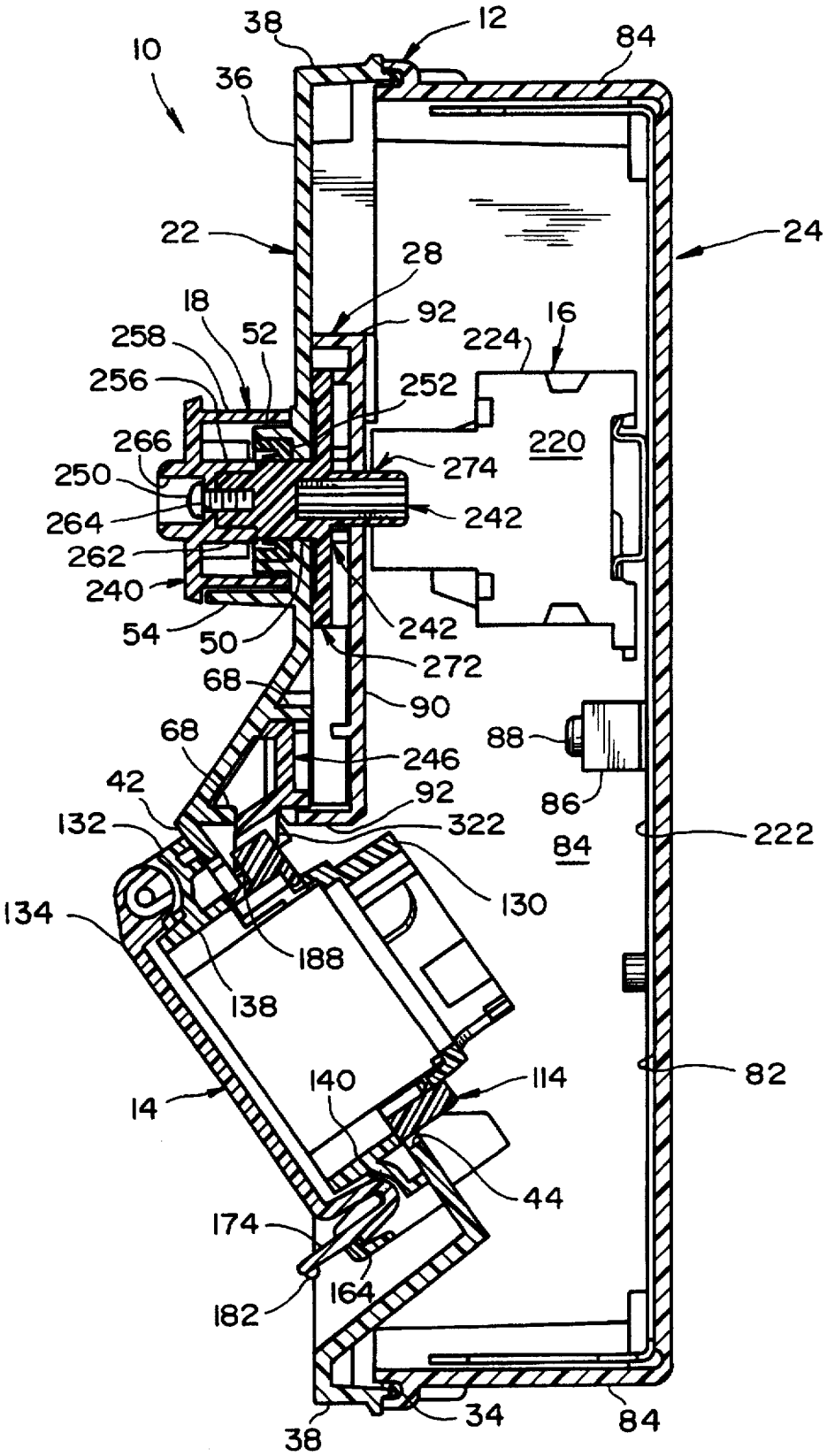
FIG. 4 is a cross-sectional view of the switched electrical device illustrated in FIGS. 1–3 taken along section line 4—4 of FIG. 1.
Figure 5:
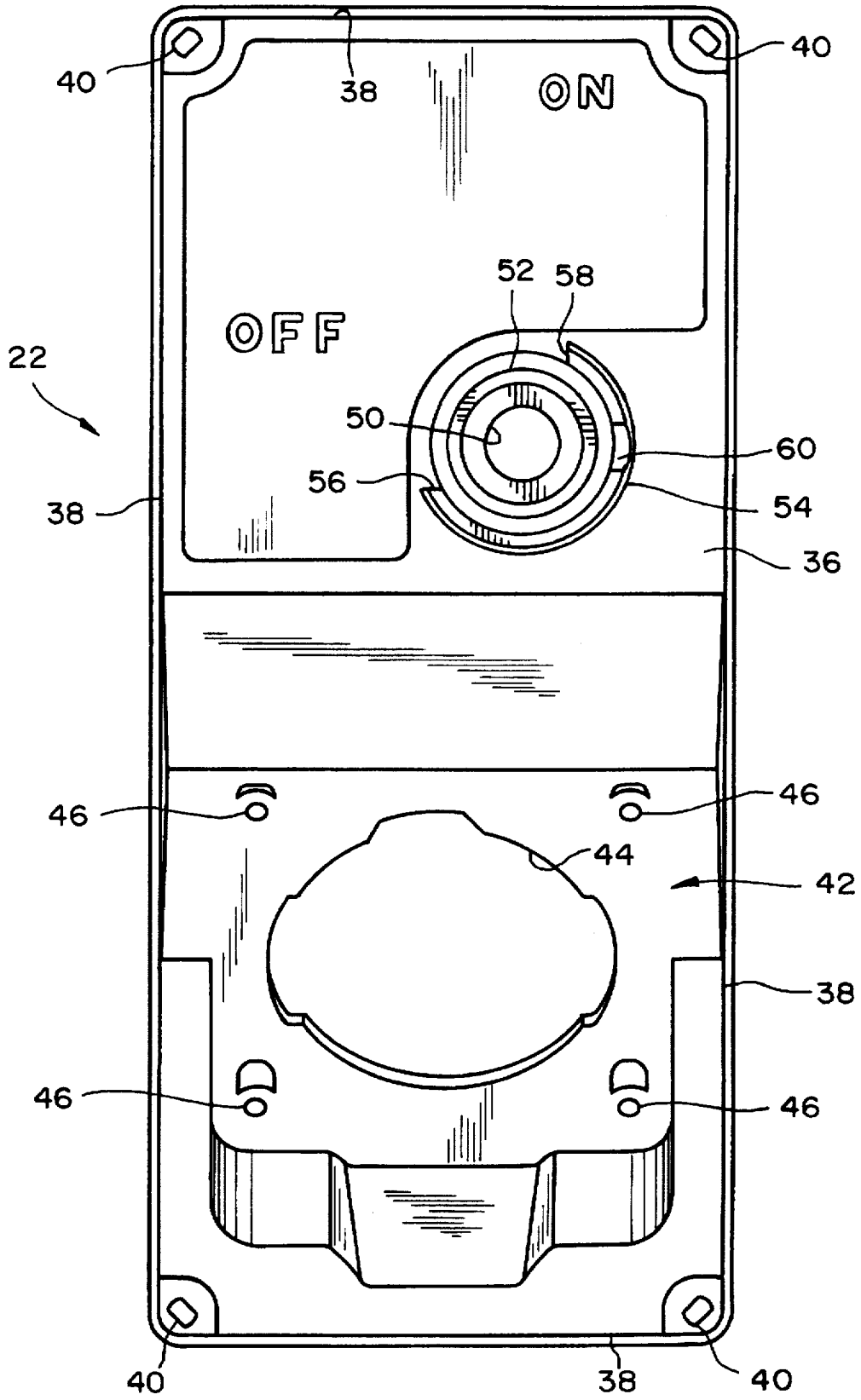
FIG. 5 is a front elevational view of the outer enclosure cover for the switched electrical device illustrated in FIGS. 1–4.
Figure 7:
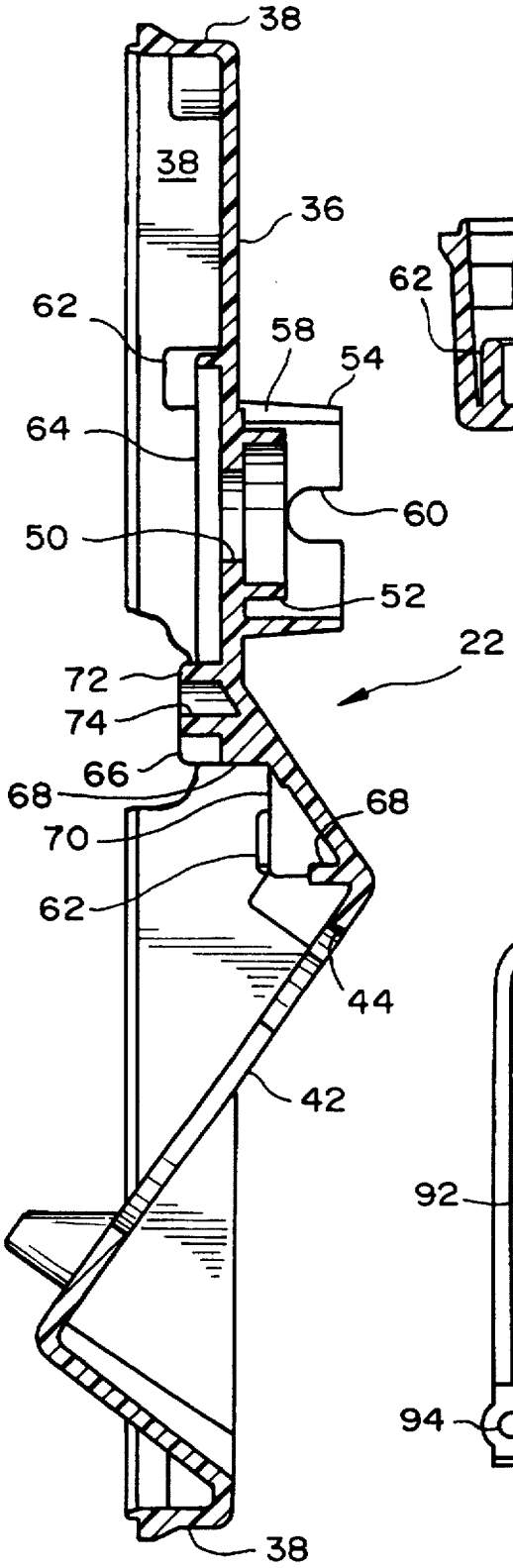
FIG. 7 is a longitudinal cross-sectional view of the outer enclosure cover illustrated in FIGS. 5 and 6 taken along section line 7—7 of FIG. 6.
Figure 8:
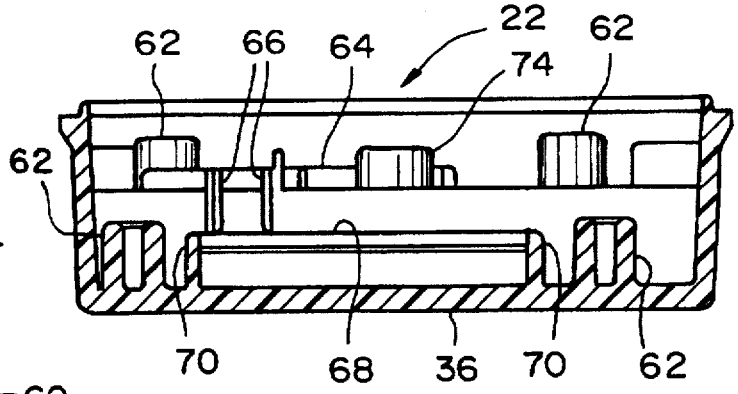
FIG. 8 is a transverse cross-sectional view of the outer enclosure cover illustrated in FIGS. 5–7 taken along section line 8—8 of FIG. 6.

Referring now to FIGS. 4, 5 and 7, top wall 36 is also provided with a hole 50, a circular flange 52 and a curved flange 54 for cooperating with mechanical interlock mechanism 18 as discussed below in more detail. Hole 50 receives a part of mechanical interlock mechanism 18 therethrough for operating mechanical interlock mechanism 18 and switch assembly 16, as discussed below. Circular flange 52 surrounds hole 50 for supporting a part of mechanical interlock mechanism 18 as discussed below. Curved flange 54 extends further outwardly from top wall 36 than circular flange 52 and is concentrically arranged about circular flange 52 but does not form a complete circle like circular flange 52. Rather, curved flange 54 forms a pair of stop surfaces 56 and 58 for limiting the movement of the part of the mechanical interlock mechanism 18 which extends through hole 50 of top wall 36 as discussed below. Also, curved flange 54 has a cutout 60 for accommodating a padlock (not shown) as discussed below.

As seen in FIGS. 1, 3 and 5, indicia such as "on" and "off" is provided on top wall 36 for indicating the position of switch assembly 16 and mechanical interlock mechanism 18 as discussed below.

Figure 6:
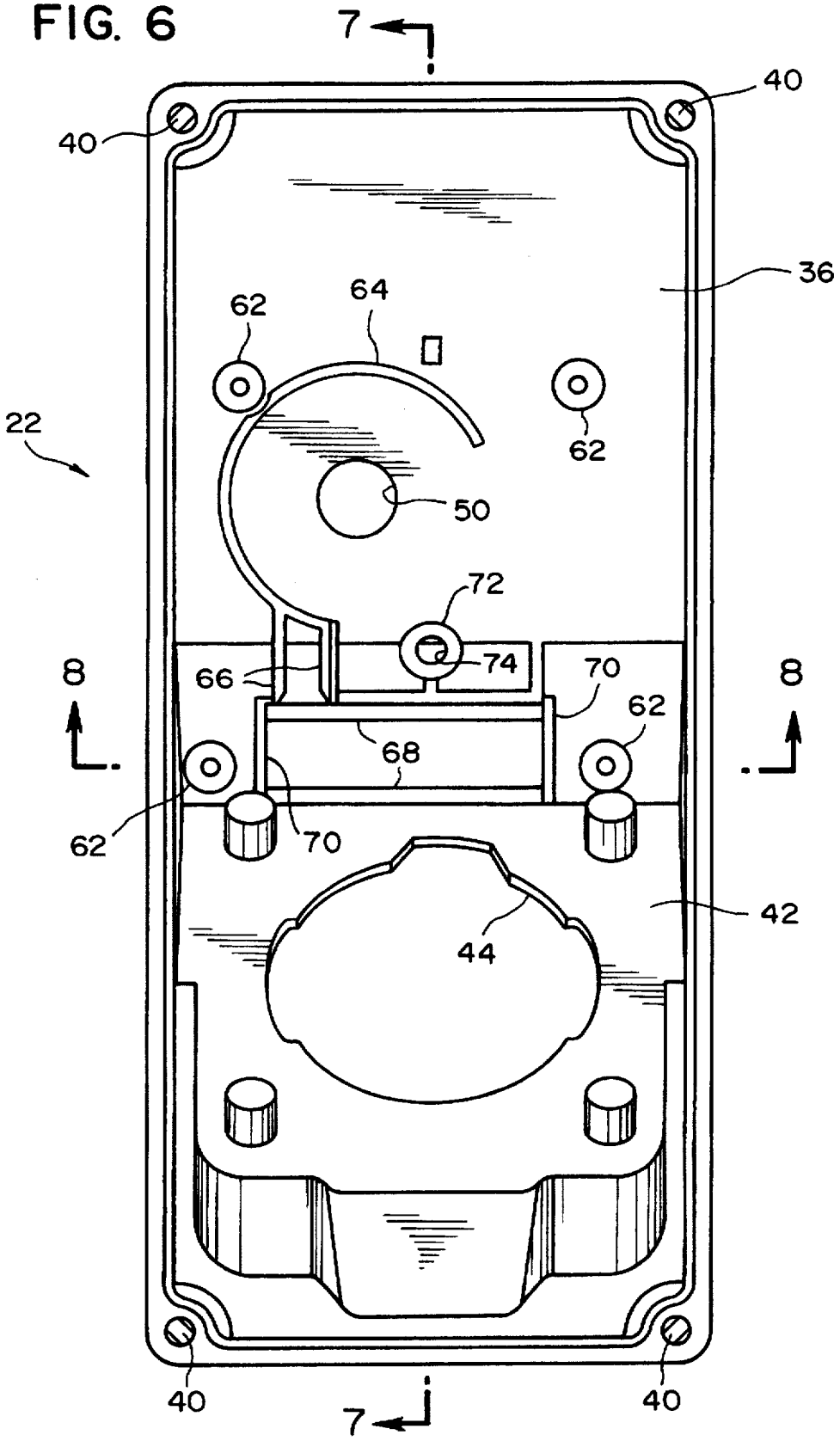
FIG. 6 is a rear elevational view of the outer enclosure cover illustrated in FIG. 5 for the switched electrical device illustrated in FIGS. 1–4.

Referring again to FIGS. 6 and 7, the back or interior surface of top wall 36 has four mounting posts 62 for threadedly receiving screws 32 to mount inner mechanism cover 28 thereto. Also, the interior surface of top wall 36 has a plurality of ribs and flanges for controlling the movement of mechanical interlock mechanism 18 which is coupled between the interior surfaces of outer enclosure cover 22 and inner mechanism cover 28.

More specifically, the interior surface of top wall 36 is provided with a curved rib 64 concentrically mounted around hole 50, a pair of first parallel guide ribs 66 extending from curved rib 64, a pair of second parallel guide ribs 68 extending perpendicular to first guide ribs 66, a pair of stop flanges 70 extending transverse to second guide ribs 68 and a pivot post 72 with a center bore 74 for pivotally supporting a part of mechanical interlock mechanism 18. These ribs and flanges will be discussed below when describing mechanical interlock mechanism 18.

Figure 2:
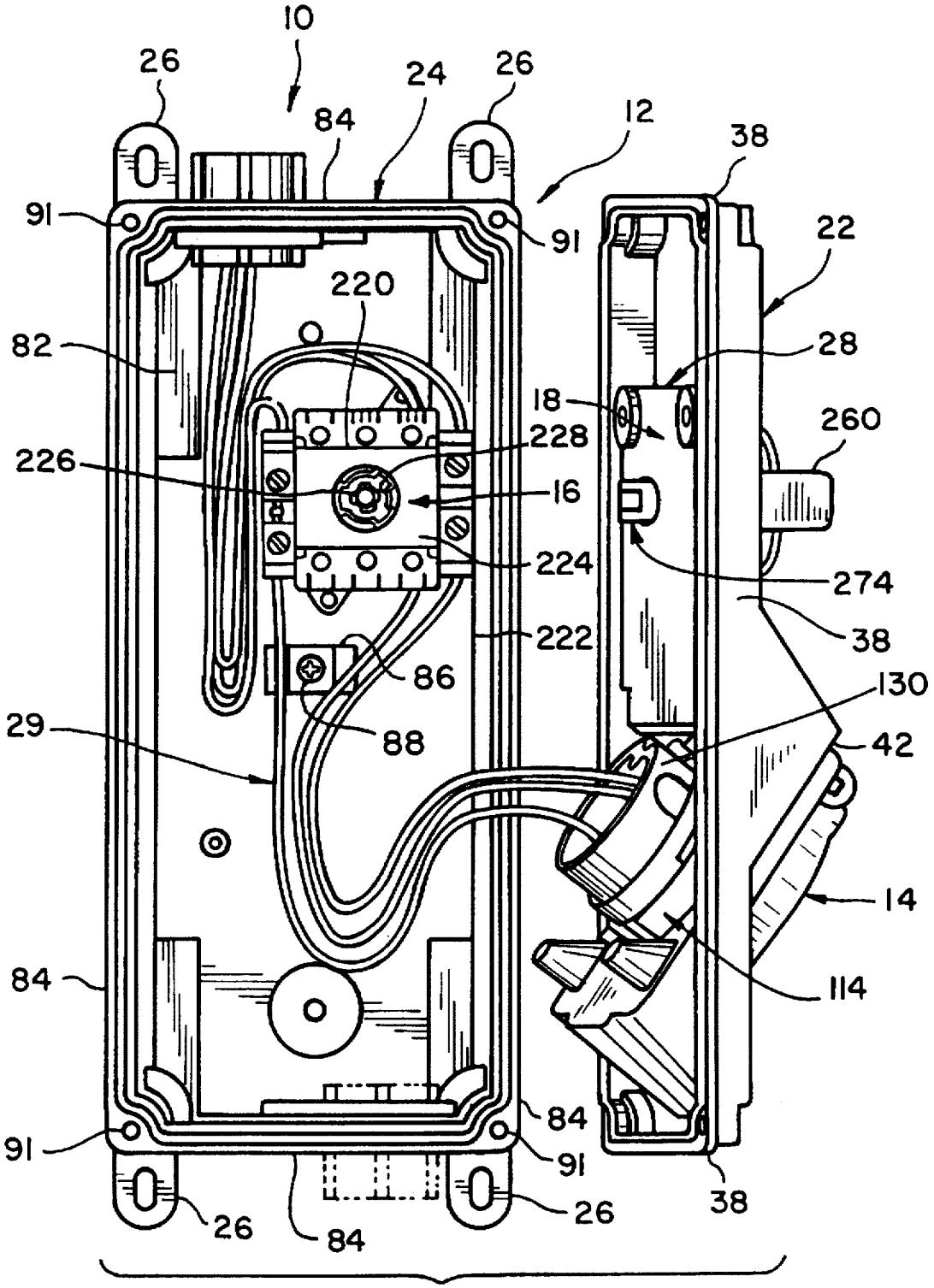
FIG. 2 is a partially exploded, front elevational view of the switched electrical device in the form of a receptacle with its enclosure cover disconnected and illustrated in perspective.

Referring to FIGS. 2–4, back enclosure member 24 is a substantially rectangular box with an open front face which is covered by outer enclosure cover 22. Back enclosure member 24 has a bottom mounting wall 82 with flanges 26 being attached thereto by screws (not shown) and four side walls 84 extending substantially perpendicular to bottom wall 82.

As seen in FIGS. 2–4, switch assembly 16 is mounted on bottom wall 82 of back enclosure member 24 by a clip 86 and a screw 88. In particular, bottom wall 82 has a post 89 extending outwardly from the center with a hole for threadedly receiving screw 88 therein.

Side walls 84 or bottom wall 82 of back enclosure member 24 can be provided with an opening for receiving electrical wires therein. Screw holes 91 are provided at the corners of side walls 84 for threadedly receiving screws 30 to releasably couple outer enclosure cover 22 to back enclosure member 24.

Figure 9:
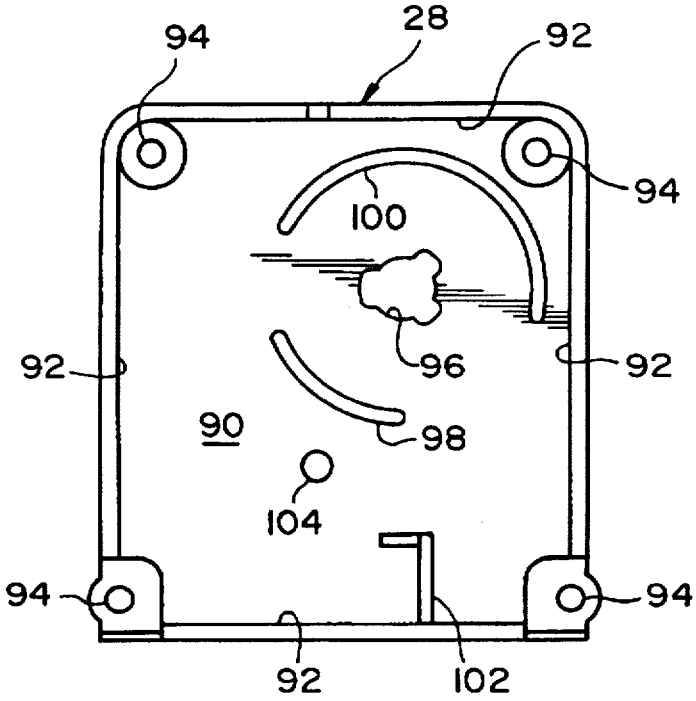
FIG. 9 is a front or inside elevational view of the inner mechanism cover for the switched electrical device illustrated in FIGS. 1–4.

As seen in FIGS. 4, 9 and 24, inner mechanism cover 28 is a substantially rectangular member having a bottom wall 90 and four side walls 92 extending perpendicularly to bottom wall 90 for receiving certain parts of mechanical interlock mechanism 18 therebetween. In particular, bottom wall 90 has four mounting holes 94 for receiving screws 32 to releasably mount inner mechanism cover 28 to the interior surface of outer enclosure cover 22 by threading screws 32 into mounting posts 62 of top wall 36 of outer enclosure cover 22.

Bottom wall 90 of inner mechanism cover 28 also has a three lobed hole 96 which is adapted to be aligned with hole 50 of outer enclosure cover 22 for receiving a part of interlock mechanism 18 therethrough as discussed below, and a pair of curved retaining ribs 98 and 100 which have their center of curvature located in the center of lobed hole 96.

When inner enclosure cover 28 is coupled to outer enclosure cover 22 by screws 32, curved retaining ribs 98 and 100 are concentrically arranged with curved rib 64 of outer cover 22 such that curved rib 64 is adjacent curved ribs 98 and 100. More specifically, curved ribs 98 and 100 lie on a circle having a diameter which is slightly smaller than the diameter of the circle in which curved rib 64 lies on.

Bottom wall 90 of inner mechanism cover 28 also includes a stop rib 102 and a pivot post 104. Stop rib 102 is designed to limit the motion of part of mechanical interlock mechanism 18 as discussed below, while pivot post 104 is received within center bore 74 of the pivot post 72 formed on the interior surface of outer enclosure cover 22.

Electrical Connector Assembly 14

Referring now to FIGS. 10–20, electrical connector assembly 14 includes a conventional electrical connector 110, an electrical connector housing 112 and a lock ring 114. Electrical connector assembly 14 is described in more detail in U.S. patent application Ser. No. 08/442,841, filed concurrently herewith in the name of John C. Anthony and entitled "Electrical Connector Housing with Lid" now U.S. Pat. No. 5,571,023, the disclosure of which is hereby incorporated herein by reference. Electrical connector 110 is illustrated as female electrical connector of the locking type which is releasably coupled to electrical housing 112 by three screws 116. It will be apparent to those skilled in the art from this disclosure, that electrical connector 110 could be a male electrical connector of the locking type if needed or desired.

Electrical connector 110, as illustrated in FIGS. 13–16, is adapted to receive mating electrical connector 20. Mating electrical connector 20, as best seen in FIG. 1, is a shrouded locking type connector which has blade contacts 120, a shroud 122 and a pair of polarizing members or keys 124 and 126. Mating electrical connector 20 is adapted to be received in electrical housing 112 for mating with electrical connector 110 by first relative axial insertion of electrical connector 20 relative to electrical connector 110 and then subsequent rotation of electrical connector 20 in electrical connector housing 112. Blade contacts 120 of mating electrical connector 20 do not fully engage the contacts of electrical connector 110 until after mating electrical connector 20 is correctly positioned and rotated within electrical housing 112.

Electrical connector housing 112 includes a tubular body portion 130 for mounting electrical connector 110 therein, a mounting flange portion 132 for mounting electrical connector housing 112 to enclosure assembly 12, and a lid 134 for covering electrical connector 110.

Tubular body portion 130 and mounting flange portion 132 are preferably integrally formed as a one piece, unitary member from a suitable hard, rigid plastic material. For example, one such suitable material is a UV-stabilized polyester blend such as GE's Valox 3570. Of course, other suitable materials known in the electrical connector art can be utilized as needed and/or desired.

Figure 12:
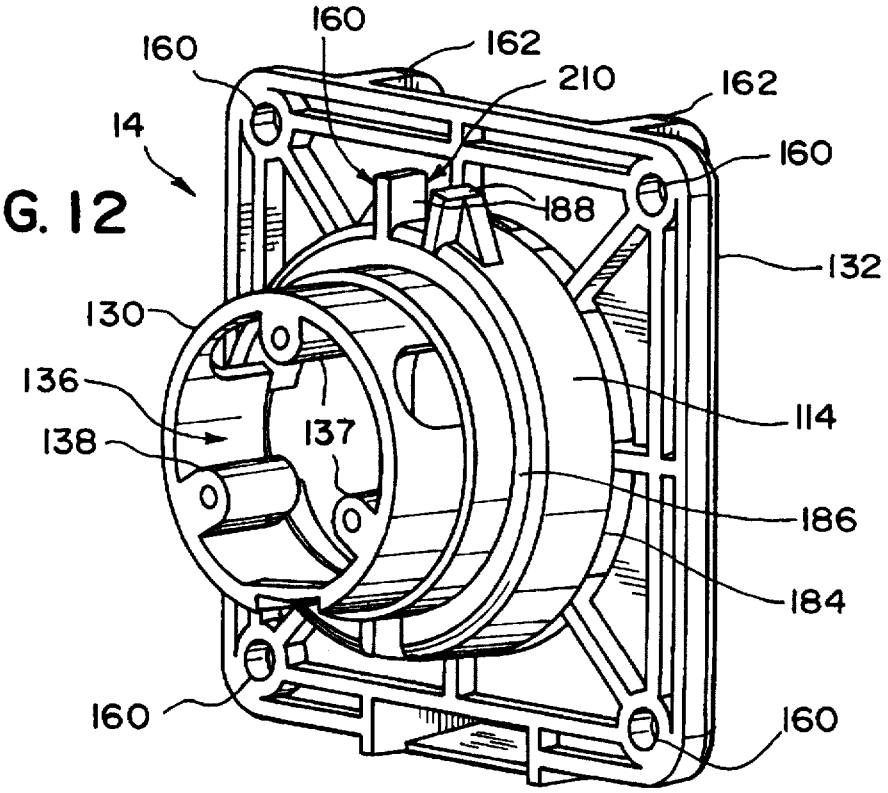
FIG. 12 is a rear perspective view of the receptacle illustrated in FIGS. 10 and 11 for the mechanical interlock mechanism with the contact retainer housing removed for clarity.
Figure 13:
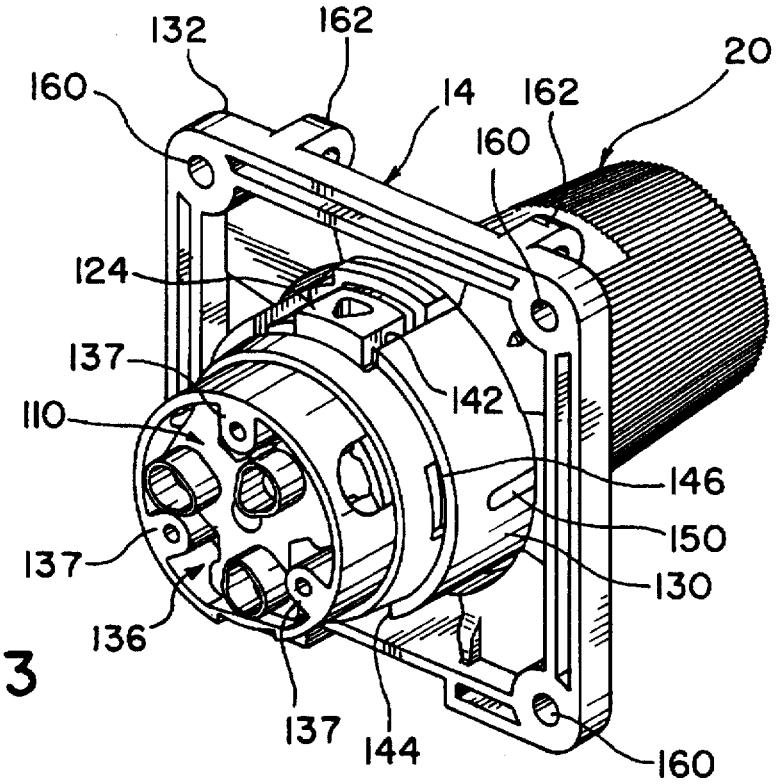
FIG. 13 is a rear perspective view of the receptacle illustrated in FIGS. 10–12 with the lock ring removed for clarity, and with the mating electrical connector inserted into the receptacle, but prior to rotation thereof.
Figure 14:
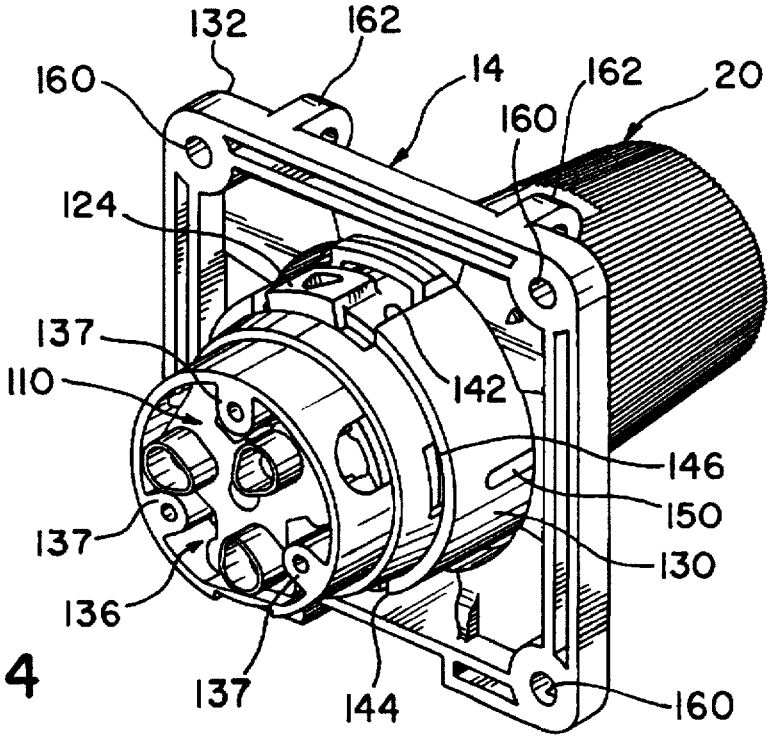
FIG. 14 is a rear perspective view of the receptacle illustrated in FIGS. 10–13 with the lock ring removed for clarity, and with the mating electrical connector inserted into and rotated within the receptacle to its locked position.

As seen in FIGS. 12–14, tubular body portion 130 has a tubular passageway 136 with three mounting bosses 138 located at its inner end for threadedly receiving screws 116 to releasably couple electrical connector 110 thereto. Of course, two or more mounting bosses, such as mounting bosses 137, can be used to secure electrical connector 110 within tubular body portion 130. When electrical connector 110 is mounted in tubular body portion 130, an annular recess is formed in tubular passageway 136 for receiving shroud 122 of electrical connector 20 therein.

Figure 10:
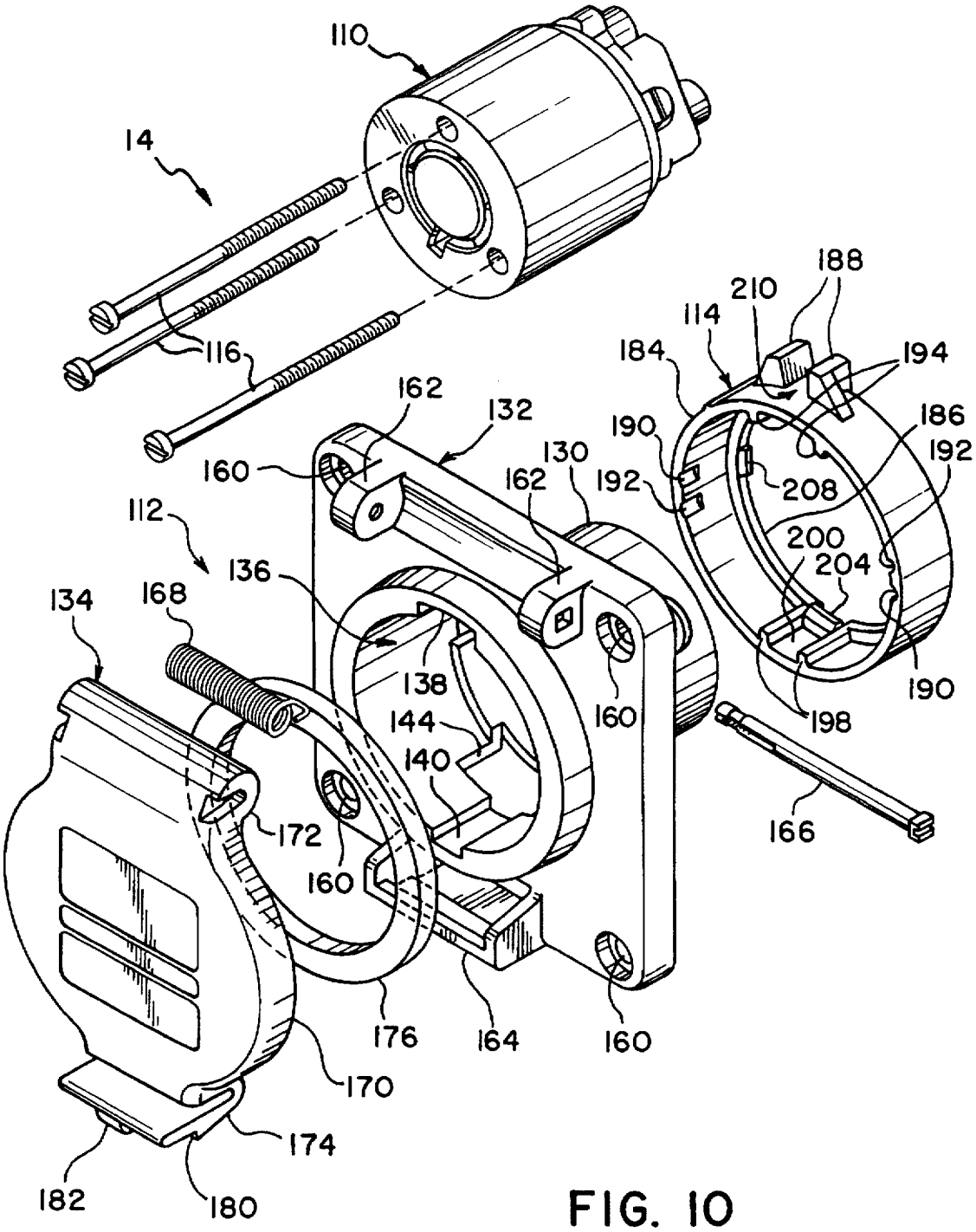
FIG. 10 is a partially exploded, front perspective view of the receptacle with lock ring for the switch electrical device and the mechanical interlock mechanism illustrated in FIGS. 1–4.

As best seen in FIGS. 10, 13 and 14, the inner surface of the tubular body portion 130 has a pair of polarizing slots 138 and 140 for receiving polarizing members 124 and 126 of electrical connector 20 therein, and a pair of circumferential openings 142 and 144 extending through the tubular body portion 130 and partially aligned with slots 138 and 140. Accordingly, polarizing members 124 and 126 of electrical connector 20 initially slide along slots 138 and 140 so that electrical connector 20 can only be received in electrical connector housing 112 in one orientation. Openings 142 and 144 are designed to receive polarizing members 124 and 126 of electrical connector 20 therein, after electrical connector 20 is fully inserted into tubular passageway 136 of electrical housing 112.

However, after full insertion of electrical connector 20 into tubular passageway 136 of electrical connector housing 112, polarizing members 124 and 126 disengage from slots 138 and 140 of electrical connector housing 112 so as to be received within openings 142 and 144. Since openings 142 and 144 extend circumferentially from slots 138 and 140 about tubular body portion 130, openings 142 and 144 allow electrical connector 20 to be rotated relative to electrical connector 110 such that polarizing members 124 and 126 move circumferentially within openings 142 and 144. This rotation of electrical connector 20 causes polarizing members 124 and 126 to be misaligned with slots 138 and 140. In this position, polarizing members 124 and 126 engage tubular body portion 130 so that electrical connector 110 cannot be pulled axially out of electrical connector housing 112 without first rotating electrical connector 20 back so that polarizing members 124 and 126 again are aligned with slots 138 and 140.

Accordingly, in order to properly connect electrical connector 20 electrical connector to electrical connector 110, polarizing members 124 and 126 must first be aligned with slots 138 and 140 so that electrical connector 20 can be first axially inserted into tubular passageway 136 of electrical connector housing 112, and then rotated such that the contacts of the electrical connectors 20 and 110 are engaged with each other.

As seen in FIGS. 13, 14 and 24, tubular body member 130 also has a second pair of openings 146 and 148 for releasably coupling lock ring 114 thereto as discussed below. Openings 146 and 148 (shown in FIG. 11) are spaced 180° apart and spaced 90° between openings 142 and 144. The exterior surface of tubular body portion 130 is provided with a pair of detents or protrusions 150 which are spaced approximately 180° apart. Protrusions 150 are adapted to overridably hold lock ring 114 in either an unlocked position or a locked position as discussed below.

As seen in FIGS. 1 and 12–14, mounting flange 132 has four mounting holes 160 for receiving screws 48 to mount electrical connector housing 112 to outer enclosure cover 22 of enclosure assembly 12. In particular, mounting flange 132 is fastened to top wall 36 of outer cover 22 so that tubular body portion 130 extends through cutout 44 of top wall 36 of outer enclosure cover 22.

As seen in FIG. 10, mounting flange 132 also includes a pair of pivot lugs 162 and a latch bar 164 for retaining lid 134 thereon. In particular, lid 134 is pivotally coupled to pivot lugs 162 by pivot pin 166 and biased to a closed position by torsion spring 168.

As seen in FIG. 10, lid 134 has a circular body portion 170 for covering the opening of tubular body portion 130, a pivot lug 172 at one end for pivotally coupling to mounting flange 132 via pivot pin 166, and a curved beam snap latch member 174 located 180° from pivot lug 172 for releasably engaging latch bar 164. Body portion 170, pivot lug 172 and latch member 174 are molded as a one piece, unitary member from a suitable rigid plastic material. Body portion 170 preferably has a foam or rubber gasket 176 fixedly mounted thereon for engaging the outer edge of tubular body portion 130. Accordingly, when lid 134 is pivoted to its closed position and is latched shut by latch 174, gasket 176 is compressed against the front edge of tubular body portion 130 to form a weathertight seal therebetween.

Latch member 174 has a U-shaped configuration to provide a resilient snap fit between latch member 174 and latch bar 164. In particular, latch member 174 is provided with a latch surface 180 for engaging latch bar 164 and a release button 182 for flexing latch member 174 for disengaging latch surface 180 from the locking surface of latch bar 164.

Referring now to FIGS. 15–20, lock ring 114 is a circular ring constructed of a substantially hard, rigid plastic material with limited flexibility and resiliency such as a polyester blend, e.g., GE's Valox 3570. Lock ring 114 should be constructed of a material having sufficient rigidity and resiliency to snap-fit onto tubular body portion 130 and to lock electrical connector 20 relative to electrical connector 110.

More specifically, lock ring 114 includes a cylindrical portion 184 which is concentrically received about the exterior of tubular body portion 130, an inwardly extending annular end wall 186 located at one edge of cylindrical portion 184 and a pair of outwardly extending operating flanges 188.

Cylindrical portion 184 has a first pair of detents or recesses 190 forming an unlocked position, and a second pair of detents or recesses 192 for releasably holding lock ring 114 in its locked position. Specifically, recesses 190 engage protrusions 150 when lock ring 114 is in its unlocked position, while recesses 192 engage protrusions 150 when locking ring is in its locked position. The word "detent" as used herein refers to either a recess or a protrusion, since lock ring 114 can be provided with protrusions rather than recesses 190 and 192, and tubular body portion 130 can be provided with recesses rather than protrusions 150 to overridably hold lock ring 114 in either a locked position or an unlocked position.

Figure 15:
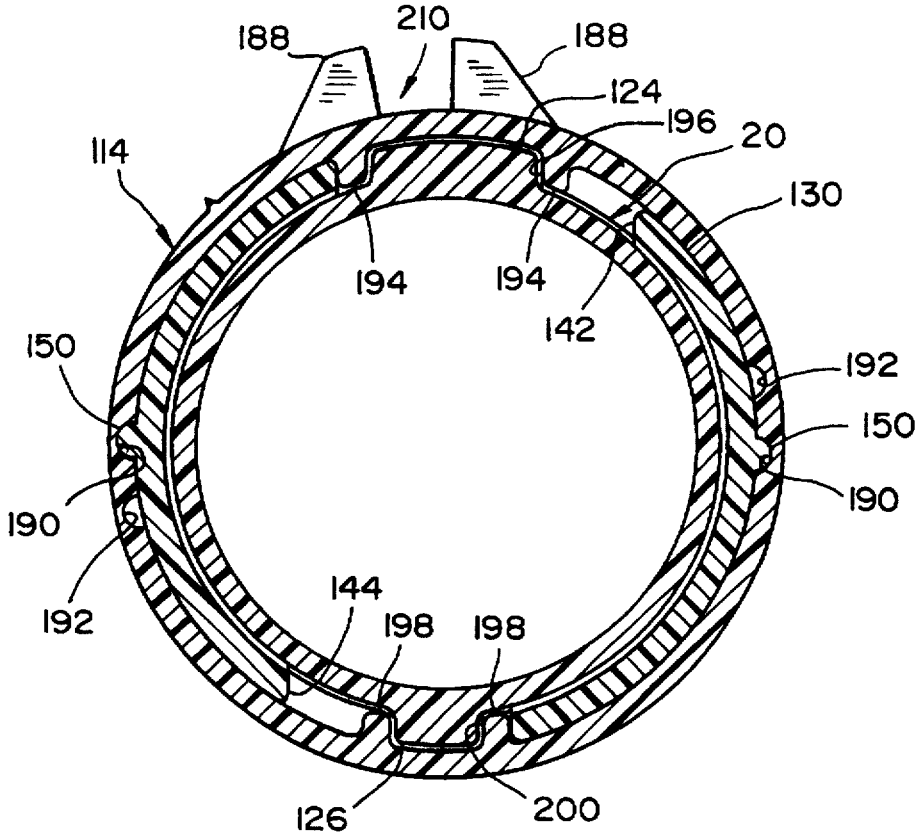
FIG. 15 is a transverse cross-sectional view of the receptacle illustrated in FIGS. 10–13 taken along section line 15—15 of FIG. 11 with the mating electrical connector insert into the receptacle, but prior to rotation thereof as illustrated in FIG. 13.
Figure 16:
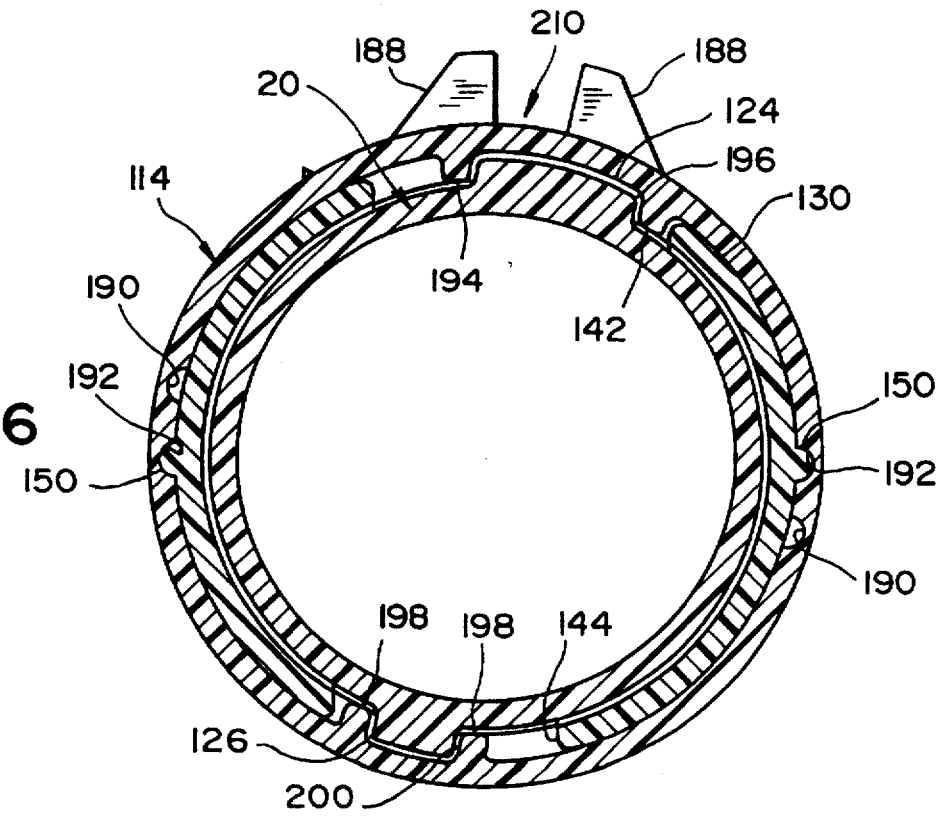
FIG. 16 is a transverse cross-sectional view of the receptacle illustrated in FIGS. 10–13 similar to FIG. 15, except that the mating electrical connector has been rotated to its locked position as illustrated in FIG. 14.
Figure 17:
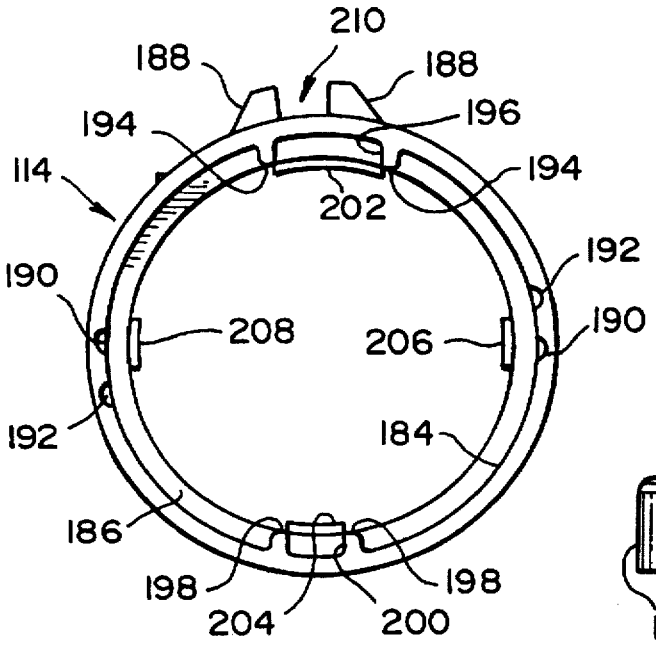
FIG. 17 is a front elevational view of the lock ring of the receptacle illustrated in FIGS. 10–12.
Figure 19:
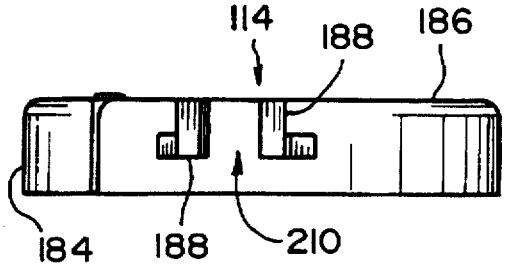
FIG. 19 is a top plan view of the lock ring illustrated in FIGS. 17 and 18 for the receptacle illustrated in FIGS. 10–12.
Figure 18:
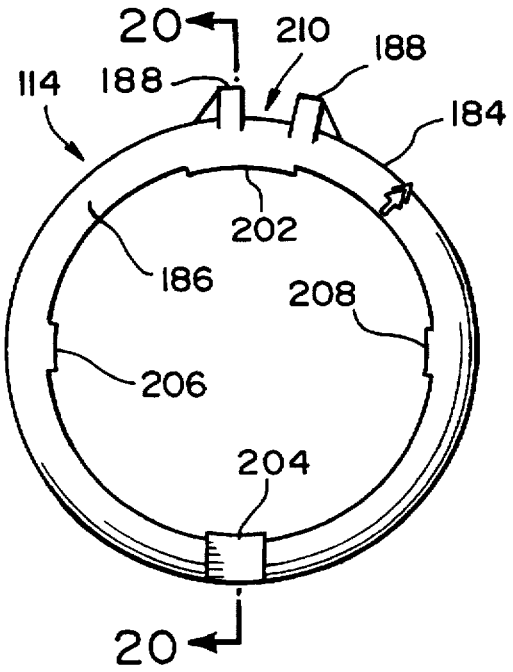
FIG. 18 is a rear elevational view of the lock ring illustrated in FIG. 17 for the receptacle illustrated in FIGS. 10–12.

As seen in FIGS. 15–17, cylindrical portion 184 also has a pair of inwardly extending ribs 194 forming a polarizing slot 196 and a second pair of ribs 198 forming a second polarizing slot 200. While two polarizing slots are disclosed herein, it will become apparent to those skilled in the art from this disclosure that one polarizing slot, or even three or more polarizing slots, can be utilized. Polarizing slots 196 and 200 are preferably different sizes and spaced 180° apart for receiving polarizing members 124 and 126, respectively. In particular, insertion of electrical connector 20 into tubular body portion 130 causes slot 196 to receive polarizing member 124 and slot 200 to receive polarizing member 126 so that electrical connector 20 can only be coupled to electrical connector 110 if their polarizing members match. Accordingly, when electrical connector 20 is inserted into passageway 136 of electrical housing 112, polarizing members 124 and 126 extend through slots 138 and 140 of the tubular body portion, and then engage slots 196 and 200, respectively, which are positioned adjacent circumferential openings 142 and 144. In this position, electrical connector 20 can be rotated within passageway 136.

Rotation of electrical connector 20 within passageway 136 of electrical connector housing 112 causes polarizing members 124 and 126 to engage slots 196 and 200 of lock ring 114 to cause lock ring 114 to rotate therewith. This rotation of locking ring 114 causes protrusions 150 to flex cylindrical portion 184 of lock ring 114 outwardly so that protrusions 150 are disengaged from recesses 190. After rotation of electrical connector 20 is completed, protrusions 150 will engage recesses 192 to overridably hold lock ring 114 in its locked position. As mentioned above, when lock ring 114 is in its locked position, polarizing members 124 and 126 are no longer aligned with slots 138 and 140, and thus electrical connector 20 cannot be removed from electrical connector housing 112 without reversing rotation of electrical connector 20.

Electrical connector 20 is removed by rotating the electrical connector in the reverse direction which causes polarizing members 124 and 126 to engage ribs 194 and 198 of slots 196 and 200 so as to rotate lock ring 114 therewith. This rotation of lock ring 114 causes protrusions 150 to be disengaged from recesses 192 and to flex cylindrical portion 184 of lock ring 114 outwardly until protrusions 150 engage recesses 190 to again to overridably hold lock ring 114 in its unlocked position.

Figure 11:
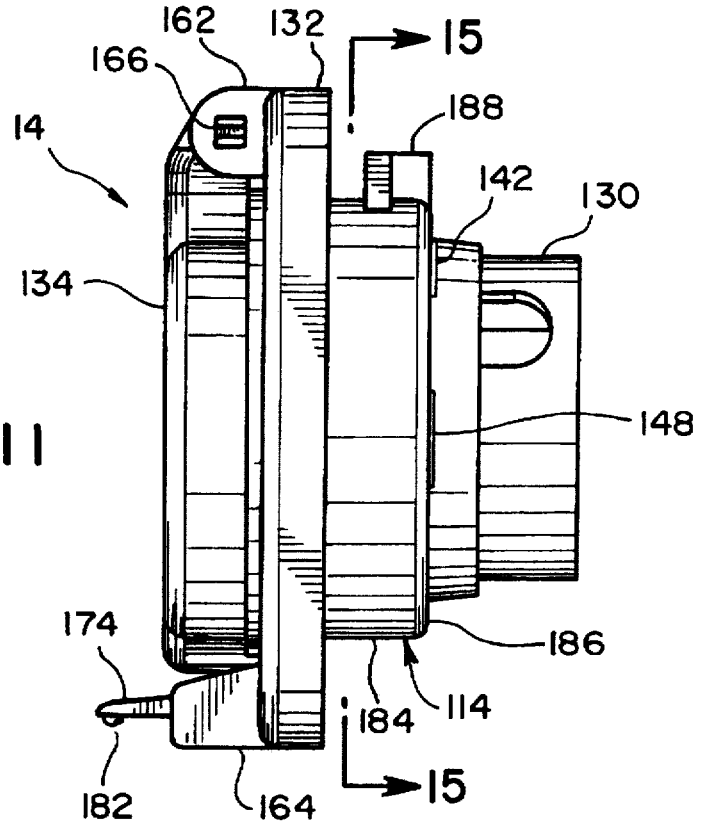
FIG. 11 is a side elevational view of the receptacle with lock ring illustrated in FIG. 5 for the electrical device and its mechanical interlock mechanism illustrated in FIGS. 1–4.
Figure 20:
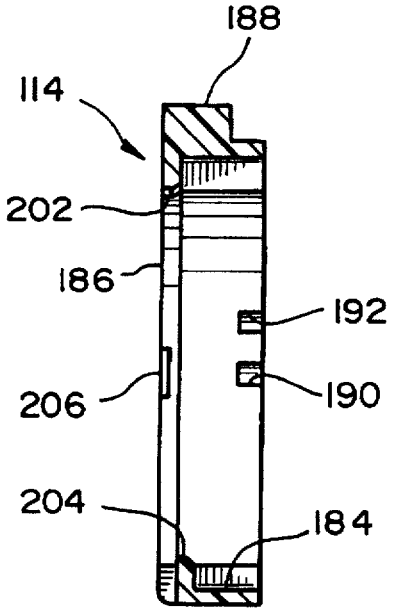
FIG. 20 is a transverse cross-sectional view of the lock ring illustrated in FIGS. 17–19 for the receptacle illustrated in FIGS. 10–12 taken along section line 20—20 of FIG. 18.

End wall 186 includes four radially inwardly extending tabs 202, 204, 206 and 208 which extend radially inwardly towards the center of lock ring 114. Tabs 202 and 204 are preferably spaced approximately 180° apart and engage openings 142 and 144 of the tubular body portion 130. Tabs 206 and 208 are also preferably spaced approximately 180° apart, but engage openings 146 and 148 of tubular body portion 130 as seen in FIG. 11. Tabs 202, 204, 206 and 208 rotatably couple lock ring 114 to tubular body portion 130 of electrical connector housing 112. Lock ring 114 is installed on tubular body portion 130 by moving lock ring 114 longitudinally over tubular body portion 130 such that the tabs 202–208 engage the outer surface of tubular body portion 130 which flexes lock ring 114 outwardly, until tabs 202–208 align with openings 142–148. To aid in this installation, each of the tabs 202, 204, 206 and 208 can be provided with an angled ramp surface as seen in FIGS. 17 and 20.

Once tabs 202–208 of lock ring 114 are aligned with openings 142–148 of tubular body portion 130, lock ring 114 will spring back to its original shape such that tabs 202–208 are received within openings 142–148. When this occurs, tabs 202–208 will engage openings 142–148 of the tubular body portion 130 to rotatably interconnect lock ring 114 on tubular body portion 130 of electrical connector housing 112. In other words, the inner diameter of tabs 202–208 is smaller than the outer diameter of tubular body portion 130 along openings 142–148 so as to retain lock ring 114 on tubular body portion 130 via a snap fit.

Openings 142–148 and tabs 202–208 are sized so that lock ring 114 can be rotated on tubular body portion 130 between its locked position and its unlocked position by polarizing members 124 and 126 of electrical connector 20 engaging slots 196 and 200. In other words, tabs 202–208 are smaller than the circumferential length of openings 142–148 to allow a limited rotational movement between lock ring 114 and tubular body portion 130 of electrical connector housing 112.

Flanges 188 of lock ring 114 form a slot 210 which is designed to engage mechanical interlock mechanism 18, as discussed below, such that switch assembly 16 can only be moved from the "off" position to the "on" position when electrical connector 20 has been inserted into electrical connector housing 112 and rotated causing lock ring 114 to be moved from its unlocked position to its locked position.

Accordingly, lock ring 114 interconnects electrical connector assembly 14 with mechanical interlock mechanism 18 so that the electrical contacts of electrical connector 110 are not energized unless mating electrical connector 20 is inserted and rotated within electrical connector housing 112 to the locked position. In addition, lock ring 114 locks mating electrical connector 20 in electrical housing 112 so that mating electrical connector 20 cannot be removed from electrical housing 112 until the switch assembly 16 is moved to the "off" position.

Of course, it will be apparent to those skilled in the art that electrical connector housing 112 with lock ring 114 can be utilized without a mechanical interlock mechanism such that lock ring 114 functions to overridably lock mating electrical connector 20 in its locked position. In other words, lock ring 114 prevents mating connector 20 from inadvertently being rotated from either its locked or unlocked position due to the detent arrangement of protrusions 150 and recesses 190 and 192 as discussed above.

Switch Assembly 16

Referring again to FIGS. 2–4, switch assembly 16 includes a switch mechanism 220 and a mounting frame 222 for mounting switch 220 to back member 24 of enclosure assembly 12. The type of switch mechanism or its details are not important to the present invention, except that switch mechanism 220 must cooperate with interlock mechanism 18. Accordingly, switch mechanism 220, as well as frame 222, will not be discussed in detail herein.

Switch mechanism 220 is preferably a conventional switch such as those manufactured by Kraus & Naimer. Basically, switch mechanism 220 has a housing 224 which is releasably mounted to frame 222 in a conventional manner, and a set of movable contacts (not shown) which are designed to be moved between opened and closed positions via mechanical interlock mechanism 18.

More specifically, housing 224 has a three lobed opening 228 in its top surface which is concentrically arranged about the three lobed shaft 226. A part of interlock mechanism 18, as discussed below, extends through lobed opening 228 to engage lobe shaft 226 for rotating lobe shaft 226 between an "on" position and an "off" position for opening and closing the contacts of the switch mechanism 220.

Mounting frame 222 is constructed of sheet metal and attached to bottom wall 82 of back member 24 of the enclosure assembly 12 via clip 86 and screw 88. As mentioned above, mounting frame 222 is not important to the present invention, and thus will not be discussed in detail herein.

Mechanical Interlock Mechanism 18

Referring now to FIGS. 21–39, mechanical interlock mechanism 18 includes an operating handle 240, an operating shaft 242 movably coupled to operating handle 240, a latch 244 designed to engage operating shaft 242 to selectively block or unlock operating shaft 242 for rotation via handle 240, a control block 246 interconnecting lock ring 114 to latch 244, and a bolt 248 interconnected with operating shaft 242 for locking control block 246 in the "on" position.

As mentioned above and as best seen in FIG. 4, mechanical interlock mechanism 18 is coupled to enclosure assembly 12 by outer enclosure cover 22 and inner mechanism cover 28. More specifically, operating handle 240 is rotatably coupled to the exterior of outer enclosure cover 22 via a screw 250 which is threaded into operating shaft 242 such that outer cover 22 is sandwiched between handle 240 and operating shaft 242 with handle 240 and operating shaft 242 being designed to rotate together. A seal 252 can be provided between operating handle 240 and outer cover 222 to provide a weathertight seal therebetween.

As seen in FIGS. 4 and 24, operating handle 240 has an inner pivot tube 256, an outer pivot tube 258, and a lever arm 260. Preferably, operating handle 240 is constructed of a hard, rigid, plastic material such as a UV-stabilized polyester blend, e.g., GE's Valox 3570. Of course, other suitable materials could be used.

Inner pivot tube 256 has a blind rectangular bore 262 for non-rotatably receiving a portion of shaft 242 therein, and a screw hole 264 formed in the end of bore 262 for receiving screw 250 therethrough to fixedly couple operating shaft 242 to operating handle 240. Accordingly, operating handle 240 is designed to rotate operating shaft 242 between an "off" position and an "on" position.

Outer pivot tube 258 is positioned between curved flanges 52 and 54 of outer cover 222 such that handle 240 is designed to be rotated therein.

As seen in FIGS. 3 and 24, lever arm 260 extends radially outwardly from pivot tubes 256 and 258 and has an opened portion 266 which aligns with cutout 60 of flange 54 so that a padlock can extend between opening 266 and cutout 60 for locking operating handle 240 in a locked position via the padlock (not shown). Also, opening 266 is aligned with the hole 264 which receives screw 250 such that screw 250 is recessed within lever arm 260. Lever arm 260 is designed to engage stop surface 56 of curved flange 52 when operating handle 240 is in its "off" position, and is designed to engage stop surface 58 of curved flange 52 when operating handle 240 is in the "on" position. Accordingly, curved flange 52 and lever arm 260 are designed to control the relative rotational or pivotal movement of operating handle 240 and operating shaft 242 coupled thereto.

Seal 252 is designed to be fitted into the circular flange 52 on the exterior surface of outer enclosure cover 22 for providing a weathertight seal between the portion of the operating shaft 242 extending through hole 50 of the outer enclosure cover 22 so as to provide a weathertight seal therebetween.

Figure 25:
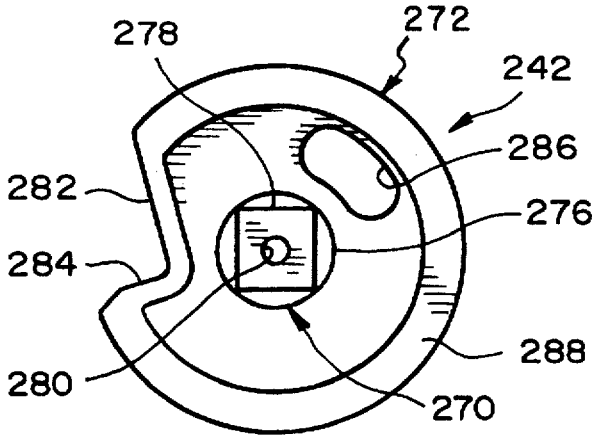
FIG. 25 is a front elevational view of the shaft for the mechanical interlock mechanism illustrated in FIGS. 21–24.
Figure 26:
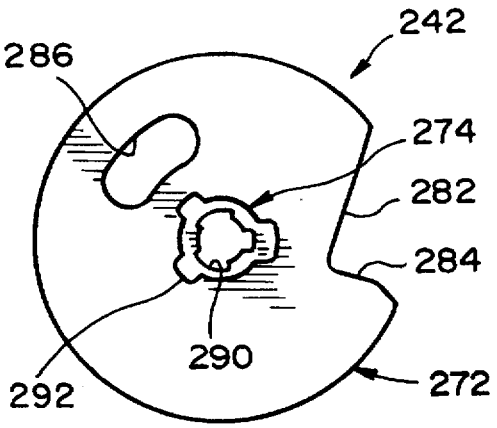
FIG. 26 is a rear elevational view of the shaft illustrated in FIG. 25 for the mechanical interlock mechanism illustrated in FIGS. 21–24.
Figure 27:
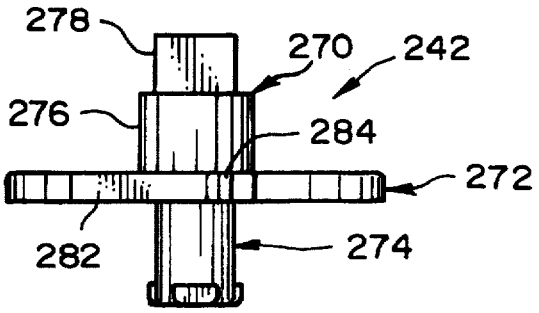
FIG. 27 is a side elevational view of the shaft illustrated in FIGS. 25 and 26 for the mechanical interlock mechanism illustrated in FIGS. 21–24.
Figure 28:
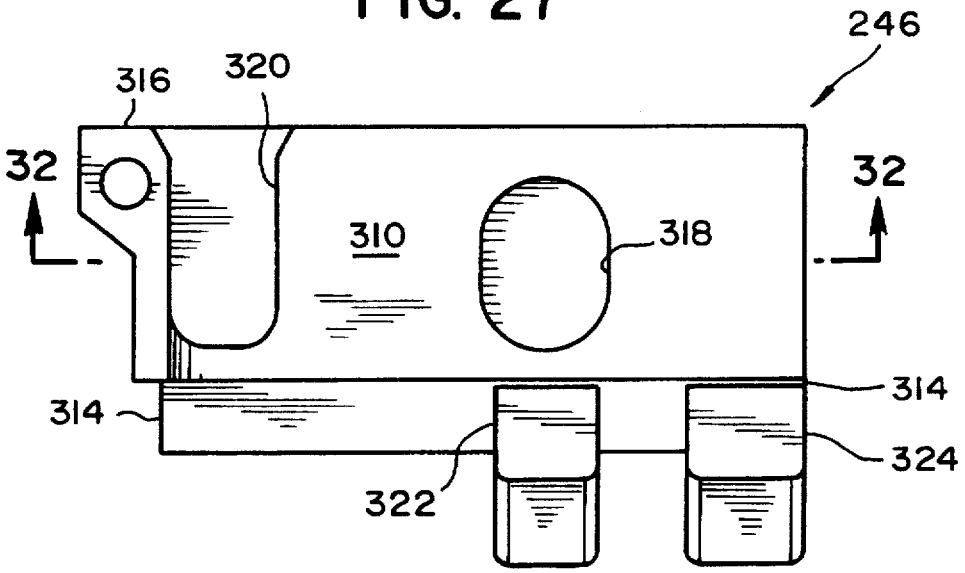
FIG. 28 is a rear elevational view of the control block for the mechanical interlock mechanism illustrated in FIGS. 21–24.
Figure 29:
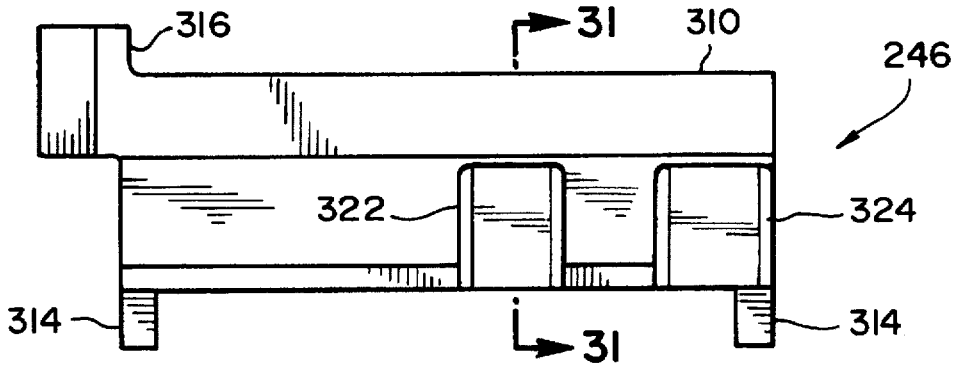
FIG. 29 is a bottom plan view of the control block illustrated in FIG. 28 for the mechanical interlock mechanism illustrated in FIGS. 21–24.
Figure 30:
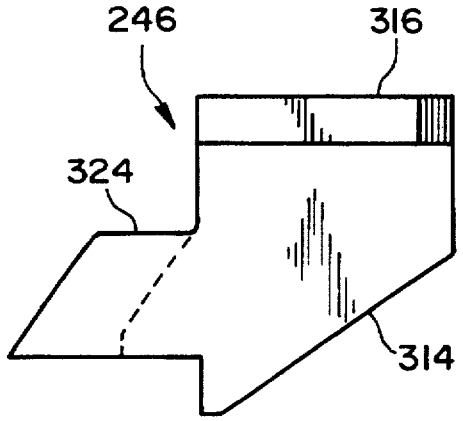
FIG. 30 is a side elevational view of the control block illustrated in FIGS. 28 and 29 for the mechanical interlock mechanism illustrated in FIGS. 21–24.
Figure 31:
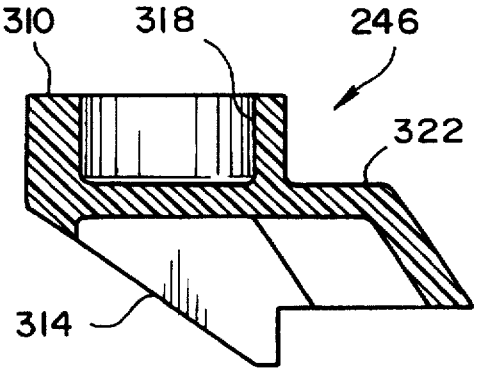
FIG. 31 is a transverse cross-sectional view of the control block illustrated in FIGS. 28–30 taken along section line 31—31 of FIG. 29.
Figure 32:
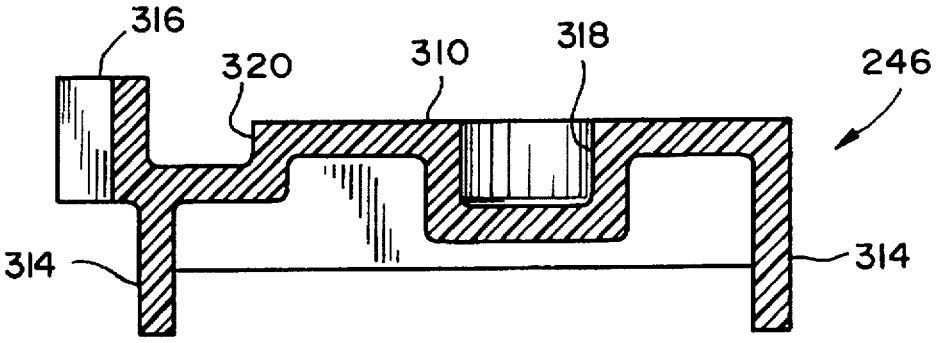
FIG. 32 is a longitudinal cross-sectional view of the control block illustrated in FIGS. 28–31 taken along section line 32—32 of FIG. 28.
Figure 33:
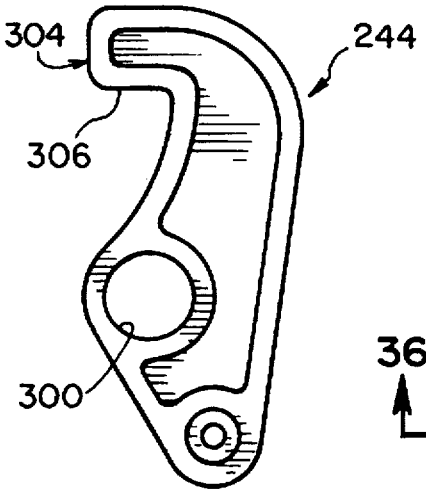
FIG. 33 is a front elevational view of the latch for the mechanical interlock mechanism illustrated in FIGS. 21–24.
Figure 34:
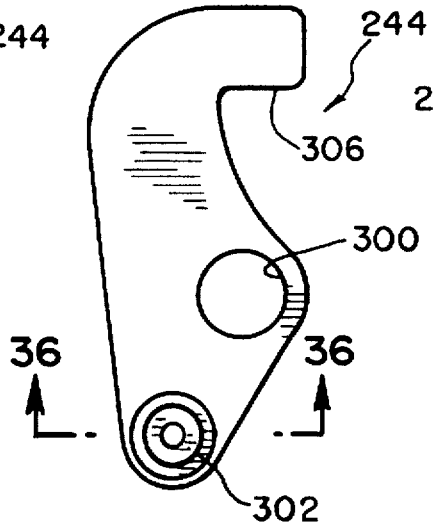
FIG. 34 is a rear elevational view of the latch illustrated in FIG. 33 for the mechanical interlock mechanism illustrated in FIGS. 21–24.
Figure 35:
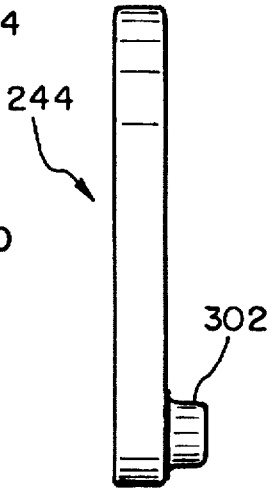
FIG. 35 is a right side elevational view of the latch illustrated in FIGS. 33 and 34 for the mechanical interlock mechanism illustrated in FIGS. 21–24.
Figure 36:
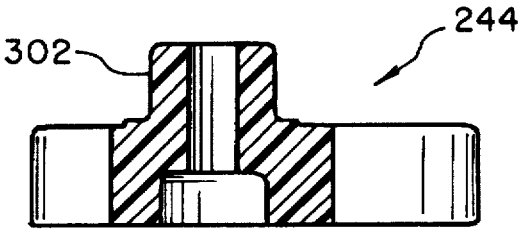
FIG. 36 is an enlarged cross-sectional view of the latch illustrated in FIGS. 33–35 taken along section line 36—36 of FIG. 34.

As seen in FIGS. 25–27, operating shaft 242 has a first shaft portion 270, a disk portion 272 and a second shaft portion 274. Preferably, operating shaft 242 is integrally formed as a one piece, unitary member constructed of a suitable material such as a hard, rigid plastic material. For example, a suitable material for operating shaft 242 is a polyester blend such as GE's Valox 3570.

First shaft portion 270 extends perpendicular to disk portion 272, and includes a first cylindrical section 276 and a polygon section 278 in the form of a square or rectangular. The free end of first shaft portion 270 also has a blind bore 280 which is adapted to threadedly receive screw 250 to fixedly couple operating handle 240 to operating shaft 242. More specifically as seen in FIG. 4, rectangular section 278 of first shaft portion 270 is received within rectangular bore 262 of operating handle 240 and fixedly coupled thereto by screw 250 such that operating handle 240 and operating shaft 242 rotate together.

Cylindrical section 276 of first shaft portion 270 is sized to frictionally receive seal 252 thereon as seen in FIG. 4. Accordingly, seal 252 engages the exterior surface of cylindrical section 276 and the interior surface of circular flange 52 to seal the interfaces therebetween.

Disk portion 272 is concentrically mounted about first shaft portion 270 and second shaft portion 274 and has a notch 282 formed in its outer circumference for receiving latch 242 therein. More specifically, notch 282 has a latch surface 284 extending radially inwardly for engaging latch 242 for selectively locking the operating shaft 242 and the operating handle 240 in the "off" position when an electrical connector 20 is not inserted into electrical connector housing 112 and rotated therein.

Disk portion 272 also has a curved arcuate slot 286 for receiving a part of bolt 248 therein. Accordingly, rotation of disk portion 272 via handle 240 causes slot 286 to move about the axis of shaft 242. This movement of slot 286 about the pivot axis of shaft 242 causes bolt 248 to move between a locking and unlocking position to either lock or unlock control block 246. In other words, bolt 248 is moved by operating shaft 242 to lock control block 246 from moving when operating handle 240 is in the "on" position. Moreover, control block 246 prevents bolt 248 from moving until electrical connector 20 is rotated within electrical connector housing 112, and therefore prevents operating shaft 242 and operating handle 240 from turning switch 220 to the "on" position.

Figure 21:
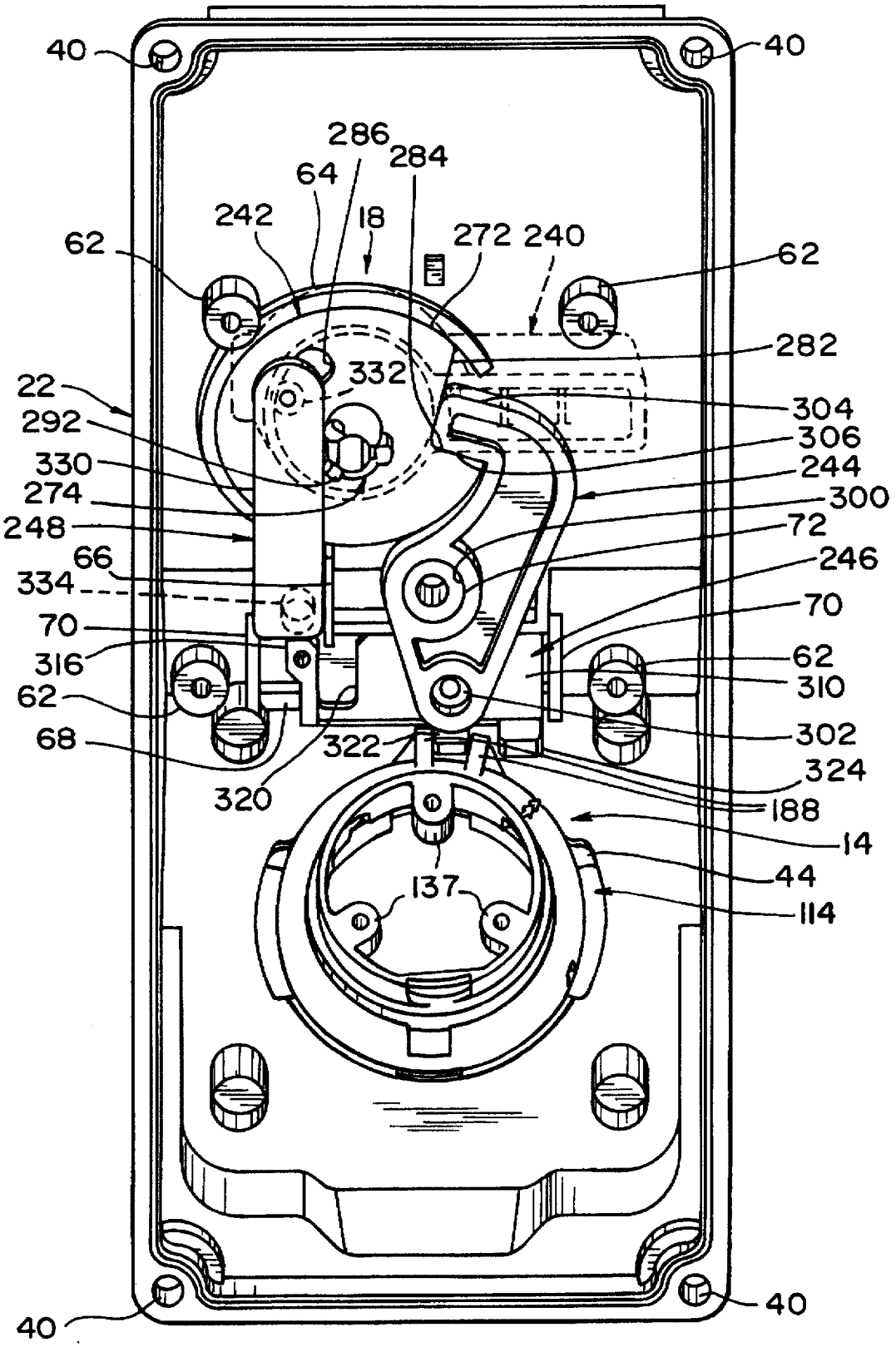
FIG. 21 is a rear elevational view of the lock ring and the receptacle with mechanical interlock mechanism for the electrical device illustrated in FIGS. 1–4 in the "off" position, with the bottom enclosure, the switch, the inner mechanism cover and certain portions of the receptacle removed for purposes of illustration.
Figure 22:
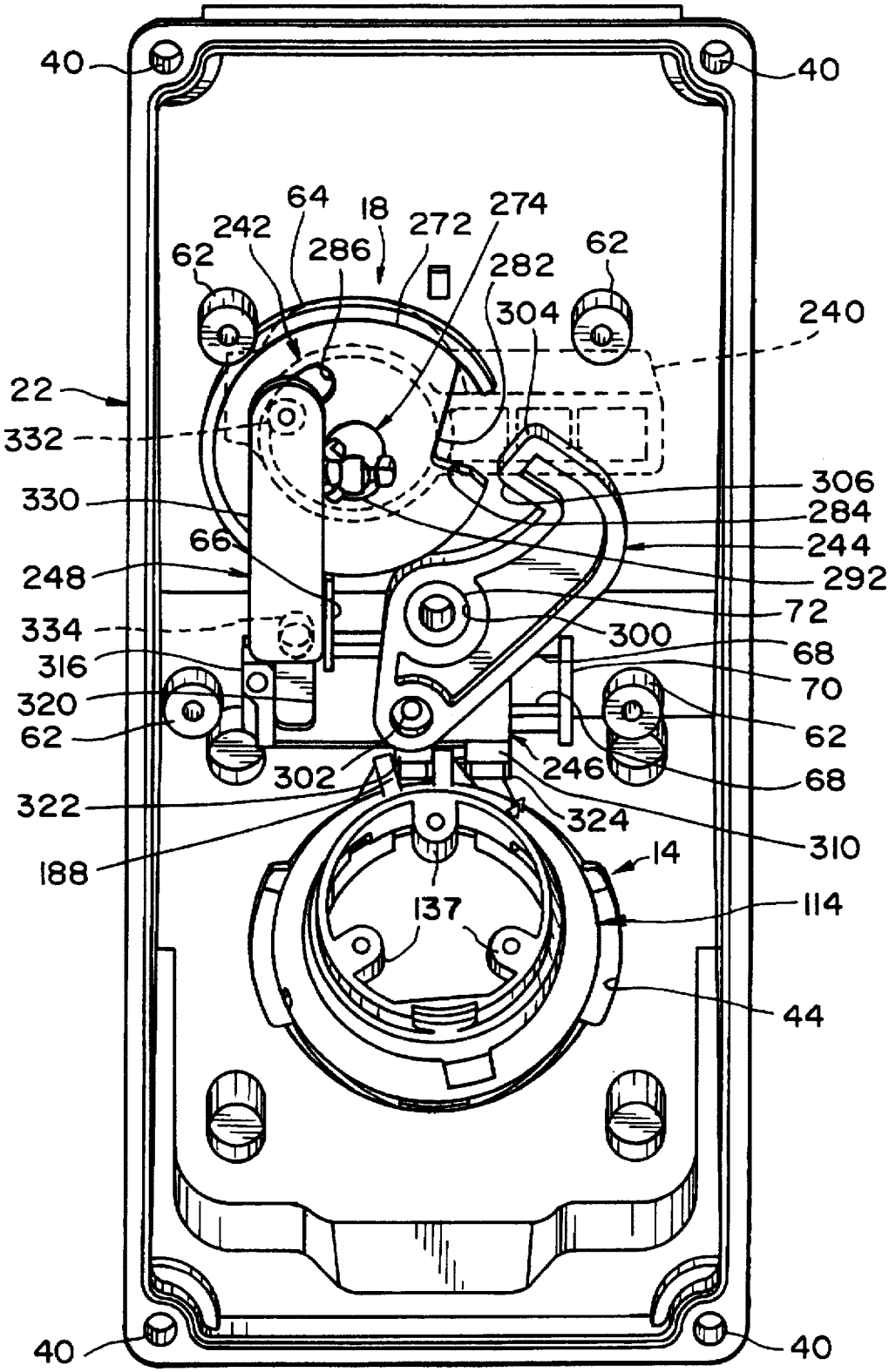
FIG. 22 is a rear elevational view of the mechanical interlock mechanism illustrated in FIG. 21 in the "off" position, but after rotation of the lock ring by the mating electrical connector (not shown) to its locked position.
Figure 23:
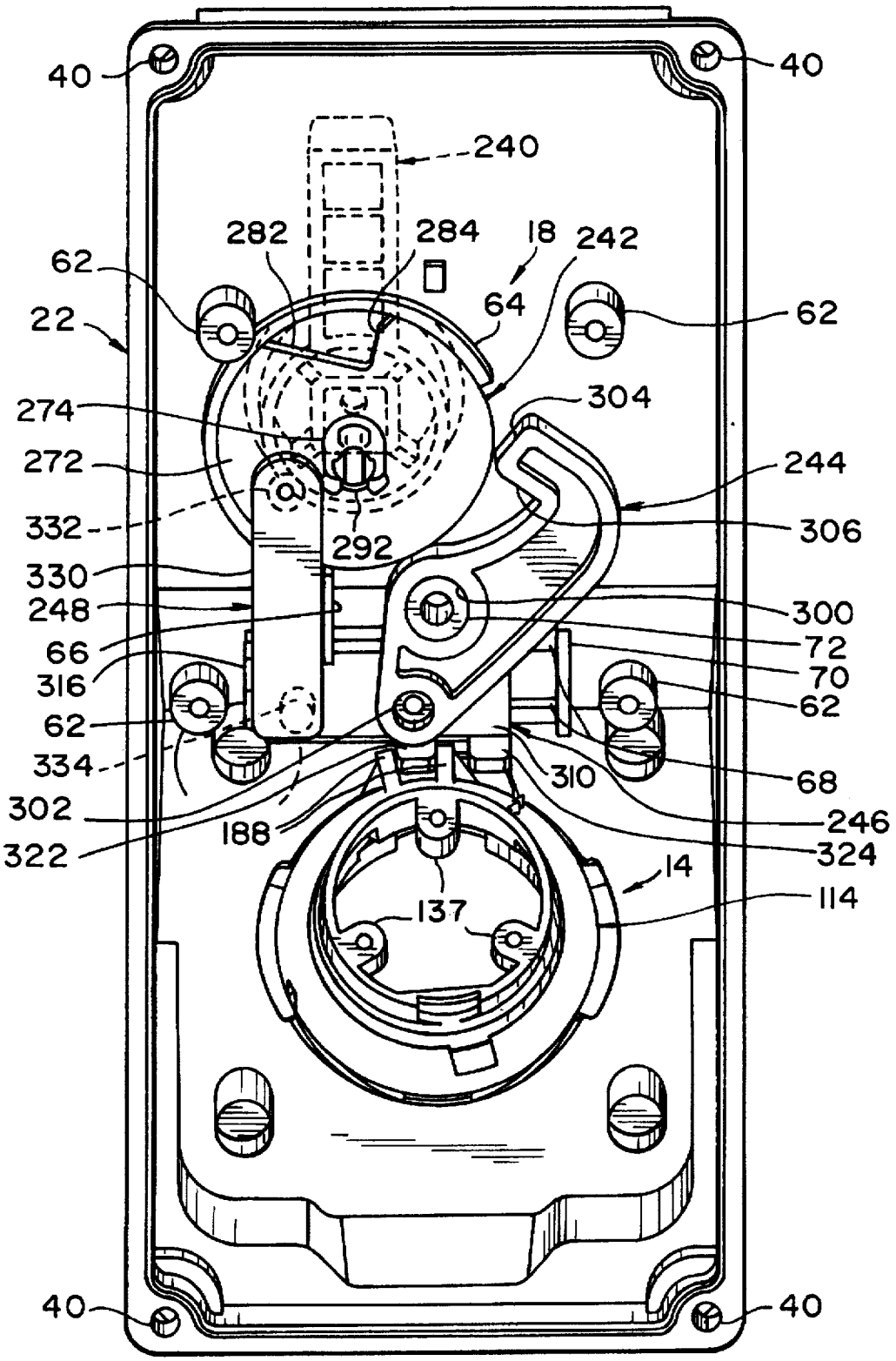
FIG. 23 is a rear elevational view of the mechanical interlock mechanism illustrated in FIGS. 21 and 22 in the "on" position and rotation of the lock ring by the mating electrical connector (not shown)

As seen in FIGS. 21–23, disk portion 272 has an outer diameter which is designed to be rotatably received within curved rib 64. The side of disk portion 272 which faces the interior surface of outer enclosure cover 22 can include a raised peripheral edge or rib 288 such that the entire surface of disk portion 272 does not engage the interior surface of outer enclosure cover 22. This raised edge or rib 288 reduces the amount of friction between disk portion 272 and the interior surface of outer enclosure cover 22 during rotation of operating shaft 242. Rib 288 also prevents excessive axial play.

The other side of disk portion 272 engages the curved ribs 98 and 100 of inner cover 28 to minimize the amount of friction therebetween. More specifically, curved ribs 98 and 100 of inner cover 28 are located on a circle having an outer diameter slightly smaller than the outer diameter of disk portion 272 such that curved ribs 98 and 100 engage disk portion 272 substantially at its circumference.

Referring to FIGS. 26 and 27, second shaft portion 274 extends substantially perpendicular to disk portion 272, and is located on the pivot axis of operating shaft 242. Second shaft portion 274 has a three lobed bore 290 which is adapted to receive the lobed shaft 226 of switch mechanism 220, and has three outwardly extending lobes 292 on its exterior surface for passing through the lobed opening 226 of the switch housing 224 and for engaging a lobed bore on the switch mechanism 220. Second shaft portion 274 also extends through the lobed hole 96 in inner cover 280 for engaging switch mechanism 220.

Referring now to FIGS. 33–36, latch 244 is somewhat L-shaped having a pivot hole 300, a pin 302 at one end, and a tooth 304 at the other end. Latch 244 is preferably integrally formed as a one piece, unitary member constructed of a suitable rigid material such as a hard, rigid plastic. For example, a suitable plastic material would be a polyester blend such as GE's Valox 3570.

As seen in FIGS. 21–23, pivot hole 300 is designed to receive pivot post 72 of outer enclosure cover 22 therein so that latch 244 is pivotally connected to enclosure assembly 12 between a latched position and an unlatched position. More specifically, latch 244 is sandwiched between outer enclosure cover 22 and inner mechanism cover 26 and pivotally maintained on pivot post 72 of outer enclosure cover 22 with inner mechanism cover 28 having its pivot post 104 located in bore 74 of pivot post 72. Pivot hole 300 is located about one-third of the length of latch 244 from the end of latch 244 with pin 302 thereon.

Pin 302 is designed to be coupled to control block 246 such that movement of control block 246 causes latch 244 to pivot about pivot post 72 of outer cover 22. In other words, movement of control block 246 causes pin 302 to move therewith which in turn pivots latch 244 about pivot post 72 causing latch tooth 304 to either engage or disengage notch 282 of disk portion 272.

In particular, latch tooth 304 has a latching surface 306 which engages latch surface 284 of notch 282 of disk portion 272 when in the latched position. However, when the latch 244 is pivoted to the unlatched position by lock ring 114 and control block 246, operating handle 240 with operating shaft 242 fixedly coupled thereto can be freely rotated from its "off" position to its "on" position.

When the operating handle 240 and the operating shaft 242 are rotated from its "off" position to its "on" position, the circumferential edge of disk portion 272 of operating shaft 242 is positioned adjacent latch tooth 304 so that latch 244 cannot be moved, and thus electrical connector 20 cannot be rotated for removal from electrical connector 110. In other words, when operating handle 240 and shaft 242 are moved to the "on" position, notch 282 is no longer aligned with tooth 304 of latch 244. Accordingly, latch 244 cannot be pivoted because it will engage the circumferential edge of disk portion 272.

Since latch 244 cannot move when operating handle 240 and operating shaft 242 are in the "on" position, lock ring 114 and control block 246 also cannot be moved from their electrical connector locked position to their electrical connector unlocked position. Stated differently, when operating handle 240 is in the "on" position, the mating electrical connector 20 cannot be removed from electrical connector housing 212 until the operating handle 240 is again moved back to the "off" position.

Control block 246 is designed to be slidably coupled to the interior surface of outer enclosure cover 22 via the second set of parallel ribs 68 of outer enclosure cover 22. This slidable movement of control block 246 relative to the interior surface of outer enclosure cover 22 is limited by stop flanges 70. Preferably, control block 246 is integrally molded as a one piece, unitary member constructed out of a suitable rigid material. For example, control block 246 can be constructed of a polyester blend such as GE's Valox 3570 blend.

Referring to FIGS. 28–32, control block 246 includes a first surface 310 for coupling with latch 244 and bolt 248, a pair of end walls 314 for engaging stop flanges 70 of outer enclosure cover 22, and for slidably engaging the interior surface of outer enclosure cover 22, and a stop member 316 for blocking movement of bolt 248.

As seen in FIGS. 21–23, first surface 310 has a slot 318 for receiving pin 302 of latch 244 therein so that sliding movement of control block 246 causes latch 244 to pivot about pivot posts 72 and 104. First surface 310 also has a bolt receiving recess 320 which receives a part of bolt 248 for locking control block 246 when operating handle 240 is moved to the "on" position. More specifically, rotation of operating handle 240 from the "off" position to the "on" position causes disk portion 272 of operating handle 242 to rotate which in turn causes bolt 248 to slide along the inner surface of. Outer enclosure cover 22 such that a portion of bolt 248 slides into recess 320. This rotational movement of operating handle 240 to longitudinal movement of bolt 248 is controlled by first parallel ribs 66 of outer enclosure cover 22 as discussed below.

Control block 246 also includes a first tab member 322 for engaging flanges 188 of lock ring 114 such that rotational movement of lock ring 114 causes control block 246 to longitudinally slide along second ribs 68 of outer enclosure cover 22. Control block 246 is also provided with a second tab member 324 which is designed to prevent misassembly of control block 246. More specifically, second tab member 324 ensures that only first tab member 322 is positioned within slot 210 between flanges 188 of lock ring 114 such that control block 246 can only be coupled in one position relative to lock ring 114. Namely, control block 246 can only be positioned on second ribs 68 of outer enclosure cover 22 such that first tab member 322 is received in slot 210 formed between flanges 188 of lock ring 114 because second tab member 324 is located on control block 246 so that one of the flanges 188 of lock ring 114 will hit tab member 324 if lock ring 114 and control block 246 are in the wrong position. This ensures that lock ring 114 and control block 246 are always properly assembled for transferring the rotational movement of the lock ring 114 to the sliding movement of control block 246.

Stop member 316 of control block 246 is designed to be movably located in and out of the path of bolt 248 such that bolt 248 cannot be moved from its retracted position to its extended position when operating handle 240 is in the "off" position. Stated differently, operating handle 240 cannot be rotated to its "on" position when stop member 316 is aligned with bolt 248 since rotation of operating handle 240 will cause bolt 248 to hit stop member 316 to prevent rotation of operating handle 240.

In normal operation of interlock mechanism 18, bolt 248 performs a backup latch 244. Thus, bolt 248 does not have to engage stop member 316 since latch surface 284 of disk portion 272 of shaft 242 will normally engage tooth 304 of latch 244. However, should the tooth 304 of latch 224 break off, then rotation of operating handle 240 from its "off" position to its "on" position is still prevented by bolt 248 engaging stop member 316 of control block 246.

Figure 37:
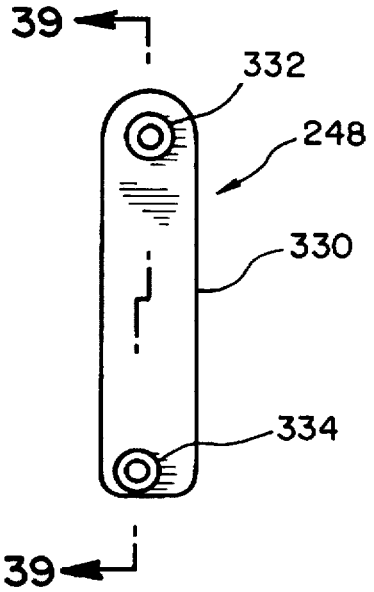
FIG. 37 is a front elevational view of the bolt for the mechanical interlock mechanism illustrated in FIGS. 21–24.
Figure 38:
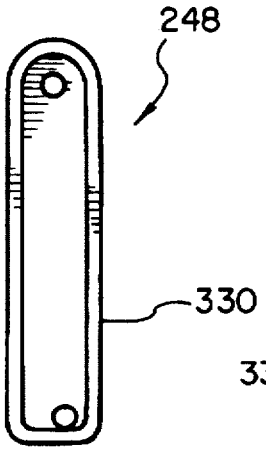
FIG. 38 is a rear elevational view of the bolt illustrated in FIG. 37 for the mechanical interlock mechanism illustrated in FIGS. 21–24.
Figure 39:
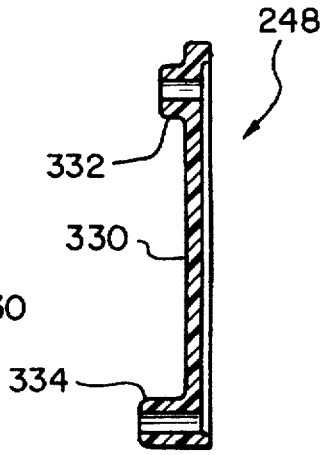
FIG. 39 is a longitudinal cross-sectional view of the bolt illustrated in FIGS. 37 and 38 taken along section line 39—39 of FIG. 37.

Referring to FIGS. 37–39, bolt 248 includes a connecting arm 330 having a first pin 332 located at one end of arm 330, and a second pin 334 at the other end of arm 330. First pin 332 is designed to be received in arcuate slot 286 of disk portion 272 of operating shaft 242, while second pin 334 is designed to be received between the parallel ribs 66 of outer enclosure cover 22.

Preferably, bolt 248 is integrally molded as a one piece, unitary member constructed of a suitable rigid material, such as a hard, rigid plastic material. For example, a suitable plastic material is a polyester such as GE's Valox 3570 blend.

As seen in FIGS. 21–23, bolt 248 is designed to longitudinally reciprocate or slide when operating handle 240 is moved between its "on" and "off" positions. More specifically, when operating handle 240 is rotated, operating shaft 242 also rotates therewith. This rotation of operating shaft 242 causes slot 386 of disk portion 272 to move bolt 248 via first pin 332. Parallel ribs 66 engage second pin 334 such that the rotational movement of shaft 242 is translated to reciprocating or longitudinal sliding movement of bolt 248. Stop rib 102 of inner mechanism cover 28 also engages connecting arm 330 to maintain bolt 148 in its correct position.

When operating handle 240 is in the "off" position, pin 332 of bolt 248 is retracted out of engagement with recess 320 of control block 246, and is aligned with stop member 316 of control block 246 so that operating handle 240 cannot be moved until control block 246 is moved as explained above. However, when mating electrical connector 20 is properly inserted and rotated in electrical connector housing 112, lock ring 114 will move control block 248 so that recess 320 is aligned with second pin 334 of bolt 248. Now, operating handle 240 can be rotated to the "on" position which will cause pin 334 of bolt 248 to slide into engagement with control block 246 such that second pin 334 of bolt 248 is received in recess 320 of control block 246 and connecting arm 330 engages stop rib 102 of inner cover 28. In this position, bolt 248 prevents control block 246 from being moved. Thus, bolt 248 locks control block 246 in place, which in turn prevents lock ring 114 and electrical connector 20 from being rotated when operating handle 240 is in its "on" position. Thus, both latch 244 and bolt 248 prevent removal of electrical connector 20 when electrical power is being supplied to electrical connector 110 via switch mechanism 220.

Operation of Electrical Switch Assembly 10

In use, electrical switch assembly 10 will normally be mounted to a support surface with its operating handle 240 in the "off" position and with lid 134 covering the opening of electrical connector housing 112. The user will then unlatch lid 134 and pivot lid 134 to expose the electrical connector 110 of electrical connector housing 112.

Now mating electrical connector 20 is initially axially inserted into annular groove 136 of electrical connector housing 112. More specifically, the polarizing members 124 and 126 of the shroud 122 are aligned with the slots 138 and 140 of tubular body portion 130 of electrical connector housing 112 such that mating connector 20 can be properly coupled to electrical connector 110. In this position, operating handle 240 cannot be rotated from the "off" position to the "on" position until rotation of electrical connector 20. Specifically, tooth 304 of latch 244 is positioned within notch 282 of disk portion 272 of operating shaft 242 to prevent operating shaft 242 and operating handle 240 from being rotated from its "off" position to its "on" position. Moreover, control block 246 is positioned such that stop member 316 of control block 246 is aligned with second pin 334 of bolt 248 to prevent movement of bolt 248. Accordingly, should latch 244 break, bolt 248 will still prevent operating arm 240 from being rotated to the "on" position, and thus prevent power from being supplied to the electrical contacts of electrical connector 110.

Operating handle 240 cannot be rotated until electrical connector 20 is properly seated within electrical connector housing 112 and then subsequently rotated such that the electrical contacts of mating connector 20 engage the electrical contacts of electrical connector 110.

Once electrical connector 20 is rotated relative to electrical connector 110, this will cause lock ring 114 to rotate therewith and move the control block 246 along ribs 68, which in turn will pivot latch 244 about pivot posts 72 and 104 so that tooth 306 disengages notch 282 of disk portion 272 of operating shaft 242. This rotation of lock ring 114 also causes protrusions 150 to disengage recesses 190 and engage recesses 192 such that lock ring 114 holds electrical connector 20 from inadvertently rotating from its unlocked position. Moreover, in this position, electrical connector 20 cannot be merely axially removed from electrical connector housing 112 without rotating electrical connector 20 in the reverse direction. More specifically, polarizing members 124 and 126 engage the edges of openings 142 and 144 of tubular body portion 130 to prevent such axial movement of electrical connector 20 without first rotating electrical connector 20 in the reverse direction.

Now that electrical connector 20 has been properly seated and rotated in electrical connector housing 112, latch 244 is no longer engaging notch 282 and recess 320 of control block 246 is now aligned with second pin 334 of bolt 248 such that operating handle 240 can move. Accordingly, operating handle 240 can easily be rotated from its "off" position to its "on" position which in turn causes operating shaft 242 to rotate therewith. Rotation of operating handle 240 also turns switch mechanism 220 from the "off" position to the "on" position for supplying electrical power via wires 29 to electrical connector 110.

With operating handle 240 in the "on" position, electrical connector 20 cannot be removed from electrical connector housing 112 since bolt 248 is received within recess 320 of control block 246 and connecting arm 330 of bolt 248 engages stop rib 102 of inner mechanism cover 28. Moreover, electrical connector 20 is prevented from being removed from electrical connector housing 112 because tooth 304 of latch 244 engages the peripheral or circumferential edge of disk portion 272 of operating shaft 242.

Of course, rotation of operating handle 240 back to its "off" position will cause bolt 248 to be retracted from recess 320 of control block 246 and realigns notch 282 of disk portion 272 with tooth 304 of latch 244. Accordingly, with operating handle 240 in its "off" position, electrical energy is no longer supplied to electrical connector 110 since operating shaft 242 has moved the switch mechanism 220 from its "on" position back to its "off" position. Moreover, in this position, electrical connector 20 can now be rotated back such that polarizing members 124 and 126 are realigned with slots 138 and 140 and electrical connector 20 can be removed by pulling electrical connector 20 axially therefrom.

While only one embodiment has been chosen to illustrate the invention, it will be understood by those skilled in the art that various changes and modifications can be made herein without departing from the scope of the invention as defined in the pending claims.

What is claimed is:

1. A switched electrical device adapted to be coupled to a complementary rotatable locking electrical connector by initial relative axial movement therebetween and subsequent relative rotational movement therebetween, comprising:

a housing having an opening for rotatably receiving a portion of the complementary locking electrical connector therein;

a rotatable locking electrical connector mounted to said housing with a first set of electrical contacts positioned adjacent to said opening of said housing for engaging a second set of electrical contacts of the complementary rotatable locking electrical connector, said first set of electrical contacts being stationary relative to said housing and being in direct contact with the second set of electrical contacts when the second set of electrical contacts are inserted and rotated in said housing to engage said first set of electrical contacts;

a switch mounted within said housing and electrically coupled to said first set of electrical contacts for selectively supplying electrical energy to said first set of electrical contacts, said switch being spaced from said electrical connector;

an operating handle movably coupled to said housing and operatively coupled to said switch between an "on" position for transmitting electrical energy to said first set of electrical contacts and an "off" position for preventing transmission of electrical energy to said first set of electrical contacts; and an interlock mechanism movably coupled to said housing for releasably locking said operating handle so that said operating handle can only move to said "on" position from said "off" position after the complementary rotatable locking connector has been inserted into said opening and rotated to a locked position with the second set of electrical contacts engaging said first set of electrical contacts.

2. A switched electrical device according to claim 1, wherein said switch is electrically coupled to said first set of electrical contacts by wires.

3. A switched electrical device according to claim 1, wherein said housing has an outer enclosure member and a back enclosure member, and said switch is attached to said back enclosure member, and said operating handle and said rotatable locking connector are attached to said outer enclosure member.

4. A switched electrical device according to claim 1, wherein said switch is rigidly attached to said housing.

5. A switched electrical device adapted to be coupled to a complementary rotatable locking electrical connector by initial relative axial movement therebetween and subsequent relative rotational movement therebetween, comprising:

a housing having an opening for rotatably receiving a portion of the complementary locking electrical connector therein;

a rotatable locking electrical connector mounted to said housing with a first set of electrical contacts positioned adjacent to said opening of said housing for engaging a second set of electrical contacts of the complementary rotatable locking electrical connector;

a switch mounted within said housing and electrically coupled to said first set of electrical contacts for selectively supplying electrical energy to said first set of electrical contacts;

an operating handle movably coupled to said housing and operatively coupled to said switch between an on position for transmitting electrical energy to said first set of electrical contacts and an "off" position for preventing transmission of electrical energy to said first set of electrical contacts; and an interlock mechanism movably coupled to said housing for releasably locking said operating handle so that said operating handle can only move to said "on" position from said "off" position after the complementary rotatable locking electrical connector has been inserted into said opening and rotated to a locked position with the second set of electrical contacts engaging said first set of electrical contacts, said interlock mechanism including a shaft with a notch coupled to said operating handle, and a latch with a tooth, said latch being movably coupled relative to said housing by rotation of the complementary rotatable locking electrical connector within said opening of said housing for selectively engaging said notch to lock said operating handle in said "off" position.

6. A switched electrical device according to claim 5, wherein said latch is pivotally coupled relative to said housing.

7. A switched electrical device according to claim 5, wherein said notch of said shaft is aligned with said tooth of said latch when said operating handle is in said "off" position and is misaligned with said tooth of said latch when said operating handle is in said "on" position.

8. A switched electrical device according to claim 7, wherein a portion of said shaft is positioned to prevent movement of said latch when said operating handle is in said "on" position.

9. A switched electrical device according to claim 8, further comprising:

a lock ring with a slot for engaging a polarizing member of the complementary rotatable locking electrical connector so that said ring rotates with the complementary rotatable locking electrical connector to move said latch.

10. A switched electrical device according to claim 9, wherein said interlock mechanism further includes a control block movably coupled relative to said housing and operatively coupled between said lock ring and said latch so that rotation of said lock ring moves said control block which in turn moves said latch.

11. A switched electrical device according to claim 10, wherein said control block is slidably coupled to said housing for substantial linear movement.

12. A switched electrical device according to claim 11, wherein said latch is pivotally coupled to said housing.

13. A switched electrical device according to claim 12, wherein said latch is coupled at one end to said control block and has said tooth adjacent said other end.

14. A switched electrical device according to claim 13, wherein said control block has a recess for receiving a pin coupled to said one end of said latch.

15. A switched electrical device according to claim 14, wherein said control block further includes at least one tab member for engaging a pair of flanges formed on said lock ring to convert rotation motion of said lock ring to linear motion of said control block.

16. A switched electrical device according to claim 15, wherein said interlock mechanism includes a bolt movably coupled relative to said housing along a path between a first position and a second position with a first end coupled to said shaft and a second free end which is located adjacent said control block when said operating handle is in said "off" position so that said control block lies with said path of said bolt.

17. A switched electrical device according to claim 16, wherein said control block further includes a slot for receiving said second end of said bolt when said control block has been moved by rotation of said lock ring.

18. A switched electrical device according to claim 17, wherein said shaft has an end portion which engages said switch for opening and closing said switch.

19. A switched electrical device according to claim 18, wherein said shaft has a disk portion with said notch formed in its peripheral edge.

20. A switched electrical device according to claim 19, wherein said disk portion further includes an arcuate slot for receiving a pin coupled to said bolt.

21. A switched electrical connector according to claim 20, further comprising:

an electrical connector housing with a tubular body portion with at least one axially extending polarizing slot and at least one circumferential opening in communication with said polarizing slot to form an abutment surface.

22. A switched electrical device adapted to be coupled to a complementary rotatable locking electrical connector by initial relative axial movement therebetween and subsequent relative rotational movement therebetween, comprising:

a housing having an opening for rotatably receiving a portion of the complementary locking electrical connector therein;

a rotatable locking electrical connector rigidly mounted to said housing with a first set of electrical contacts positioned adjacent to said opening of said housing for engaging a second set of electrical contacts of the complementary rotatable locking electrical connector;

a switch mounted within said housing and electrically coupled to said first set of electrical contacts for selectively supplying electrical energy to said first set of electrical contacts;

an operating handle movably coupled to said housing and operatively coupled to said switch between an "on" position for transmitting electrical energy to said first set of electrical contacts and an "off" position for preventing transmission of electrical energy to said first set of electrical contacts;

an interlock mechanism movably coupled to said housing for releasably locking said operating handle so that said operating handle can only move to said "on" position from said "off" position after the complementary rotatable locking connector has been inserted into said opening and rotated to a locked position with the second set of electrical contacts engaging said first set of electrical contacts; and a lock ring with a slot for engaging a polarizing member of the complementary rotatable locking electrical connector so that said ring rotates relative to said electrical connector with the complementary locking electrical connector to move said interlock mechanism.

23. A switched electrical device according to claim 22, wherein said lock ring is cylindrical and positioned around said electrical connector.

* * * * *